US010626835B2

(12) United States Patent
Noguchi

(10) Patent No.: US 10,626,835 B2
(45) Date of Patent: Apr. 21, 2020

(54) NOZZLE PLATE FOR FUEL INJECTION DEVICE

(71) Applicant: ENPLAS CORPORATION, Saitama (JP)

(72) Inventor: Koji Noguchi, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 141 days.

(21) Appl. No.: 15/558,845

(22) PCT Filed: Mar. 14, 2016

(86) PCT No.: PCT/JP2016/057894
§ 371 (c)(1),
(2) Date: Sep. 15, 2017

(87) PCT Pub. No.: WO2016/148093
PCT Pub. Date: Sep. 22, 2016

(65) Prior Publication Data

US 2018/0073478 A1 Mar. 15, 2018

(30) Foreign Application Priority Data

Mar. 17, 2015 (JP) ..... 2015-053165

(51) Int. Cl.
*F02M 61/18* (2006.01)
*F02M 61/16* (2006.01)
(Continued)

(52) U.S. Cl.
CPC ..... *F02M 61/1833* (2013.01); *F02M 51/061* (2013.01); *F02M 61/04* (2013.01);
(Continued)

(58) Field of Classification Search
CPC .. F02M 61/1833; F02M 61/04; F02M 51/061; F02M 61/162; F02M 61/163; F02M 61/1853
(Continued)

(56) References Cited

U.S. PATENT DOCUMENTS 5,752,316 A * 5/1998 Takagi ..... B23P 15/16 29/888.4
6,405,945 B1 6/2002 Dobrin
(Continued)

FOREIGN PATENT DOCUMENTS

EP 1 186 774 3/2002
EP 2 009 276 9/2012
(Continued)

OTHER PUBLICATIONS

International Search Report dated May 24, 2016 in International (PCT) Application No. PCT/JP2016/057894.

*Primary Examiner* — Steven J Ganey
(74) *Attorney, Agent, or Firm* — Wenderoth, Lind & Ponack, L.L.P.

(57) ABSTRACT

Fuel flows from first and second fuel guide channels into the swirl chamber and is guided to the nozzle hole while swirling in the swirl chamber in the identical direction. The nozzle hole is divided into an inlet portion near a fuel-inflow end and an outlet portion near a fuel-outflow end. The outlet portion has a flow passage cross-sectional area gradually increasing towards a fuel outflow-side opening end, and includes a curved surface formed by smoothly connecting an inner surface of the nozzle holes at an upstream end side in a fuel flow direction to an inner surface of the nozzle holes at the portion near the fuel-inflow end so as to smoothly and gradually increase the flow passage cross-sectional area. The curved surface ensures further thin film-like flow by expand-
(Continued)

ing a flow of the fuel in the nozzle holes by the Coanda effect.

7 Claims, 18 Drawing Sheets

(51) Int. Cl.
*F02M 61/04* (2006.01)
*F02M 51/06* (2006.01)

(52) U.S. Cl.
CPC ..... *F02M 61/162* (2013.01); *F02M 61/163* (2013.01); *F02M 61/1853* (2013.01)

(58) Field of Classification Search
USPC ..... 239/584, 585.1, 585.4, 585.5, 492–496, 239/DIG. 7
See application file for complete search history.

(56) References Cited

U.S. PATENT DOCUMENTS

| | | | | |
|---|---|---|---|---|
| 8,827,187 | B2 * | 9/2014 | Kobayashi | F02M 57/04 239/601 |
| 2008/0105767 | A1 | 5/2008 | Fujii et al. | |
| 2009/0020633 | A1 | 1/2009 | Limmer et al. | |
| 2013/0206870 | A1 | 8/2013 | Saito et al. | |

FOREIGN PATENT DOCUMENTS

| | | |
|---|---|---|
| GB | 2499482 | 8/2013 |
| JP | 10-507240 | 7/1998 |
| JP | 2001-27167 | 1/2001 |
| JP | 2002-98028 | 4/2002 |
| JP | 2003-120472 | 4/2003 |
| JP | 2008-14216 | 1/2008 |
| JP | 2008-64038 | 3/2008 |
| JP | 2009-8087 | 1/2009 |
| JP | 2013-167161 | 8/2013 |

* cited by examiner

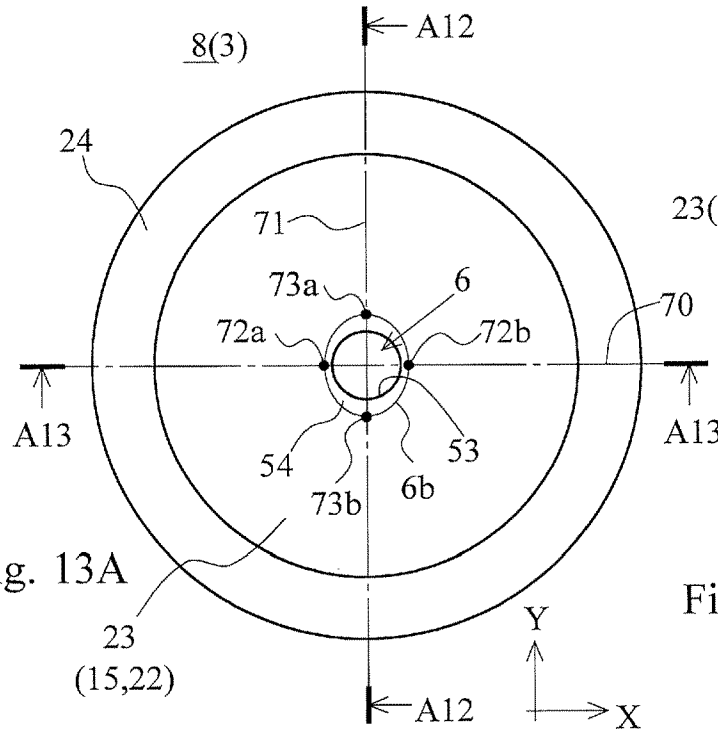
Fig. 13A
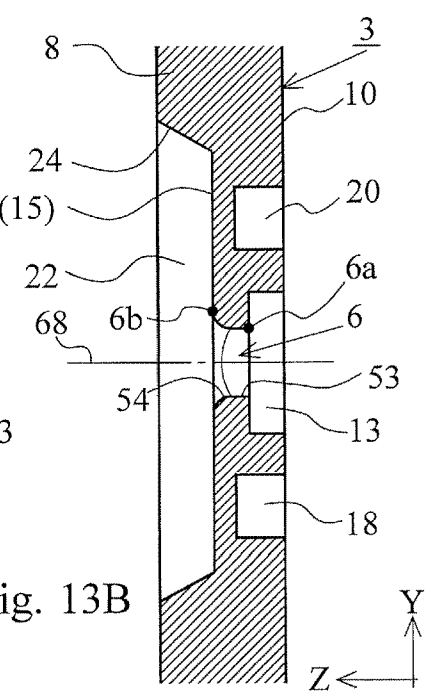
Fig. 13B
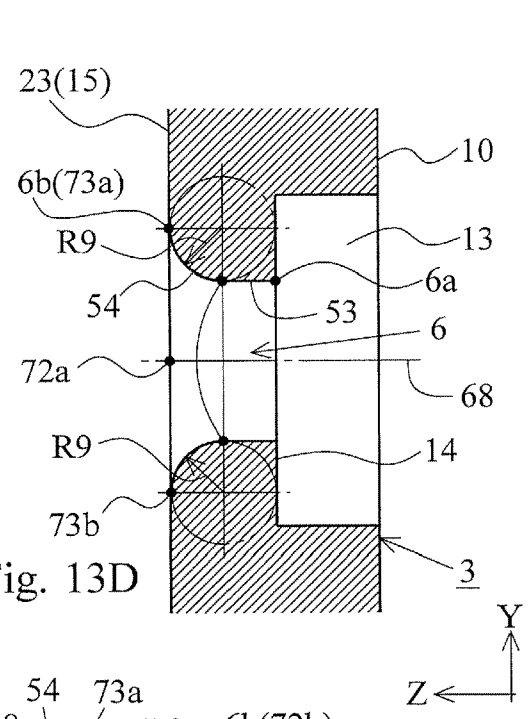
Fig. 13D
Fig. 13C
Fig. 13E

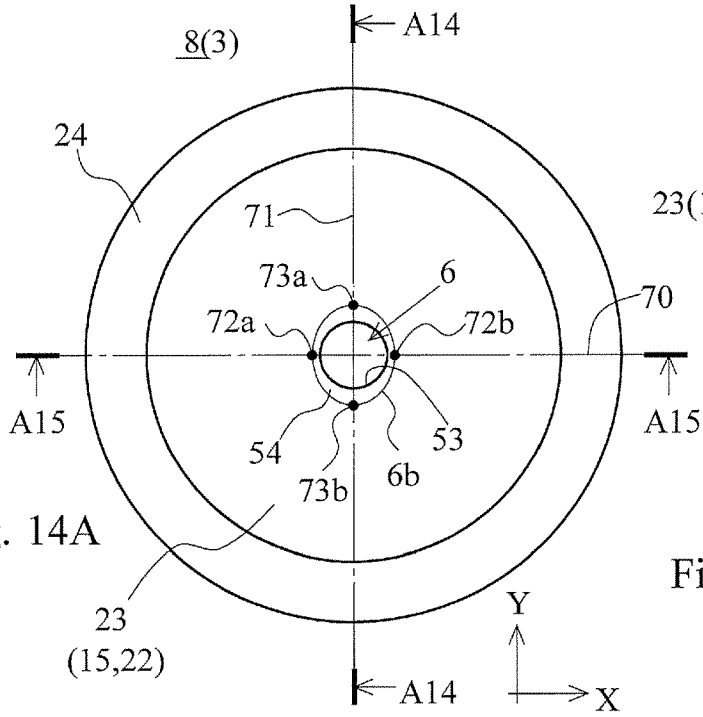
Fig. 14A
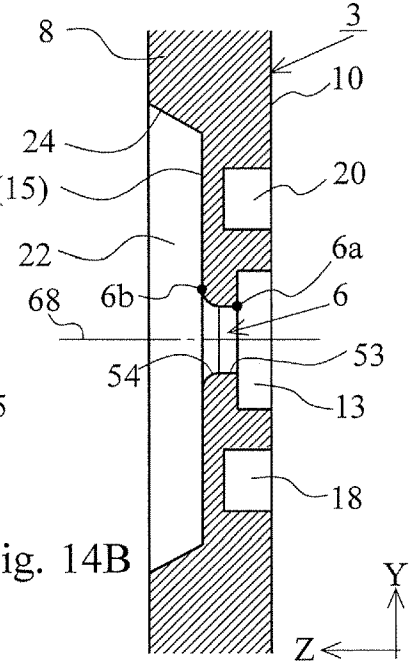
Fig. 14B
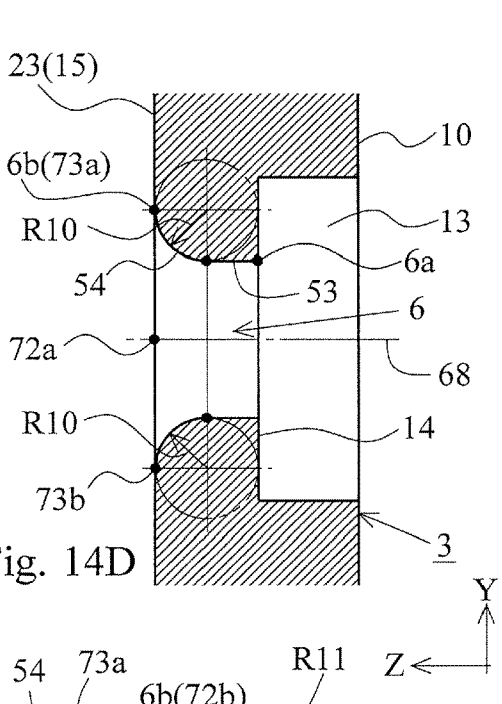
Fig. 14D
Fig. 14E
Fig. 14C

NOZZLE PLATE FOR FUEL INJECTION DEVICE

TECHNICAL FIELD

The present invention relates to a nozzle plate for a fuel injection device (hereinafter abbreviated as a nozzle plate as necessary), which is mounted on a fuel injection port of the fuel injection device, and injects fuel flowed out from the fuel injection port after atomizing the fuel.

BACKGROUND ART

An internal combustion engine (hereinafter abbreviated as "engine") of an automobile or the like is configured such that a combustible mixed gas is formed by mixing fuel injected from a fuel injection device and air introduced into the engine through an intake pipe, and the combustible mixed gas is burned in the inside of the cylinder. It has been known that, in such an engine, a mixing state of the fuel injected from the fuel injection device and the air largely influences the performance of the engine. Particularly, it has been known that the atomization of the fuel injected from the fuel injection device becomes an important factor, which influences the performance of the engine.

Such a fuel injection device, in order to ensure the atomization of the fuel in spraying, is configured such that a nozzle plate is mounted on a fuel injection port of a valve body to inject the fuel from a plurality of fine nozzle holes formed on this nozzle plate.

FIG. 16 shows such a conventional nozzle plate 100. This nozzle plate 100 shown in FIG. 16 has a laminated structure formed such that a first nozzle plate 101 and a second nozzle plate 102 are laminated. Then, as shown in FIG. 16 and FIG. 17, at the first nozzle plate 101, a pair of first nozzle holes 103A and 103B, which pass through front and rear surfaces of the first nozzle plate 101, are formed at positions on a center line 104, which extends along a Y-axis, and positions that are mutually line-symmetric with respect to a center line 105, which extends along an X-axis. As shown in FIG. 16 and FIG. 18, at the second nozzle plate 102, a pair of second nozzle holes 106A and 106B are formed at positions on the center line 105, which extends along an X-axis direction, and positions that are mutually line-symmetric with respect to the center line 104, which extends along the Y-axis. These pair of second nozzle holes 106A and 106B are communicated with the first nozzle holes 103A and 103B via a pair of curving channels 108A and 108B (a first curving channel 108A and a second curving channel 108B) formed at a side of a surface (front surface) 107 bumped against the first nozzle plate 101. At the second nozzle plate 102, the pair of curving channels 108A and 108B are communicated with one another by a communication channel 110, which extends along the center line 104.

The conventional nozzle plate 100 shown in FIG. 16 guides the fuel injected from the fuel injection port of the valve body into the curving channels 108A and 108B from the first nozzle holes 103A and 103B, and while performing a swirling movement to the fuel flowed into the curving channels 108A and 108B by the curving channels 108A and 108B, flows the fuel outside from the second nozzle holes 106A and 106B to ensure improvement of a quality of the fuel atomization (see Japanese Unexamined Patent Application Publication No. 10-507240).

However, as shown in FIG. 16 and FIG. 18, in the conventional nozzle plate 100, the second nozzle holes 106A, 106B of the second nozzle plate 102 are shaped in a round hole having the same inner diameter consistently from a fuel inflow end (an opening end on the first nozzle plate 101 side) to a fuel outflow end (an opening end on the side of an outer surface of the second nozzle plate 102), in which the fuel outflow end is a sharp edge orthogonal to the outer surface of the second nozzle plate 102. Therefore, the fuel particle in spraying is insufficiently atomized and homogeneous.

Therefore, an object of the present invention is to provide a nozzle plate that can sufficiently spreads the spray generated by injection of fuel from a nozzle hole, ensures further minute fuel microparticles in spraying, and ensures the further homogeneous fuel microparticles in spraying.

SUMMARY OF THE INVENTION

The present invention relates to a nozzle plate for a fuel injection device 3 disposed opposed to a fuel injection port 5 of a fuel injection device 1. The nozzle plate has nozzle holes 6 through which fuel injected from the fuel injection port 5 passes. According to the present invention, the nozzle holes 6 are coupled to the fuel injection port 5 via a swirl chamber 13 and fuel guide channels 18, 20, 62 that open into the swirl chamber 13, and are divided into a portion near fuel-inflow end 51 and a portion near fuel-outflow end 52. The nozzle holes 6, the swirl chamber 13, and the fuel guide channels 18, 20, 62 are formed on a plate body portion 8 positioned opposed to the fuel injection port 5. The swirl chamber 13 is configured to guide the fuel flowed from the fuel guide channels 18, 20, 62 into the nozzle holes 6 while swirling the fuel, and is formed at a side of an inner surface 10 opposed to the fuel injection port 5 of the plate body portion 8. Also, the portion near fuel-outflow end 52 of the nozzle holes 6 is formed so as to have a flow passage cross-sectional area gradually increasing towards a fuel outflow-side opening end 6*b*, and includes a curved surface 54 formed by smoothly connecting an inner surface of the nozzle holes 6 at upstream end side in a fuel flow direction to an inner surface of the nozzle holes 6 at the portion near fuel-inflow end 51 so as to smoothly and gradually increase the flow passage cross-sectional area. The curved surface 54 is configured to ensure further thin film-like flow by expanding a flow of the fuel in the nozzle holes 6 by Coanda effect.

EFFECTS OF THE INVENTION

In a nozzle plate according to the present invention, the fuel flowed from the fuel guide channel into the swirl chamber is guided to the nozzle hole while swirling in the swirl chamber, the fuel flowing swirlingly in the nozzle hole generates a flow along the curved surface of the nozzle hole by means of Coanda effect, thus expanding the fuel flow by the curved surface to form a thin film-like flow. As a result, a nozzle plate according to the present invention sufficiently spreads the spray generated by injection of fuel from a nozzle hole, ensures further minute fuel microparticles in spraying compared to conventional examples, and ensures the further homogeneous fuel microparticles in spraying compared to conventional examples.

BRIEF DESCRIPTION OF THE DRAWINGS

FIG. 13A is an enlarged view of a part of the nozzle plate (periphery of the nozzle holes) (corresponding to FIG. 3A), FIG. 13B is a cross-sectional view taken along a line A12-A12 in FIG. 13A (corresponding to FIG. 3B), FIG. 13C is a cross-sectional view taken along a line A13-A13 in FIG. 13A, FIG. 13D is a partial enlarged view of FIG. 13B (corresponding to FIG. 3D), and FIG. 13E is a partial enlarged view of FIG. 13C.

FIG. 14A is an enlarged view of a part of the nozzle plate (periphery of the nozzle holes) (corresponding to FIG. 13A), FIG. 14B is a cross-sectional view taken along a line A14-A14 in FIG. 14A (corresponding to FIG. 13B), FIG. 14C is a cross-sectional view taken along a line A15-A15 in FIG. 14A, FIG. 14D is a partial enlarged view of FIG. 14B (corresponding to FIG. 13D), and FIG. 14E is a partial enlarged view of FIG. 14C.

DESCRIPTION OF PREFERRED EMBODIMENTS

Embodiments of the present invention are described in detail by reference to drawings hereinafter.

First Embodiment

Figure 1:
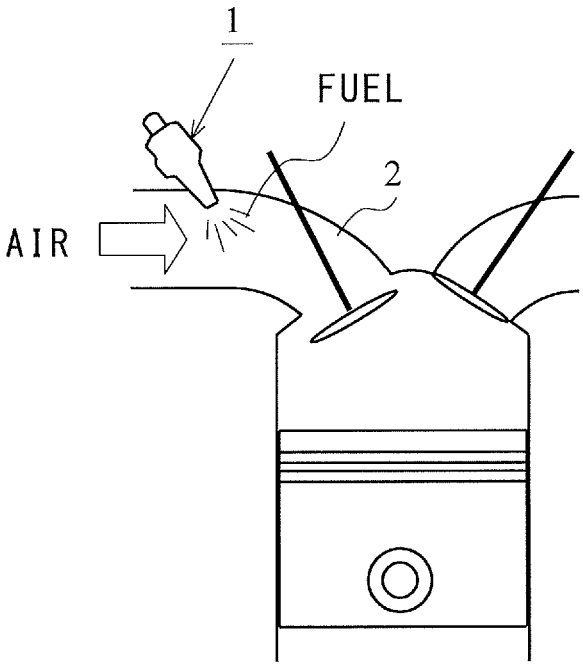
FIG. 1 is a view schematically showing an in-use state of a fuel injection device on which a nozzle plate for a fuel injection device according to a first embodiment of the present invention is mounted.

FIG. 1 is a view schematically showing an in-use state of a fuel injection device 1 on which a nozzle plate according to a first embodiment of the present invention is mounted. As shown in FIG. 1, the fuel injection device 1 of a port injection method is mounted in a middle portion of an intake pipe 2 of an engine, and is configured to generate a combustible mixed gas by injecting fuel into the inside of the intake pipe 2 and mixing the fuel and air introduced into the intake pipe 2.

Figure 2C:
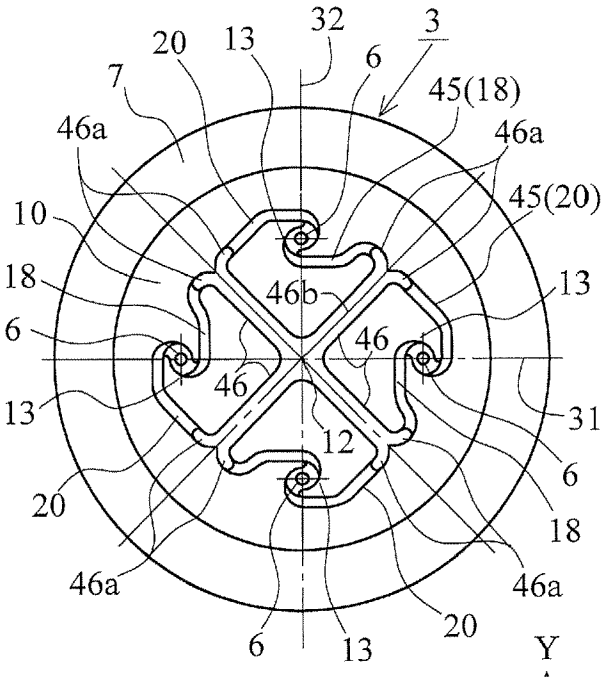
FIG. 2C is a back view of the nozzle plate.
Figure 2B:
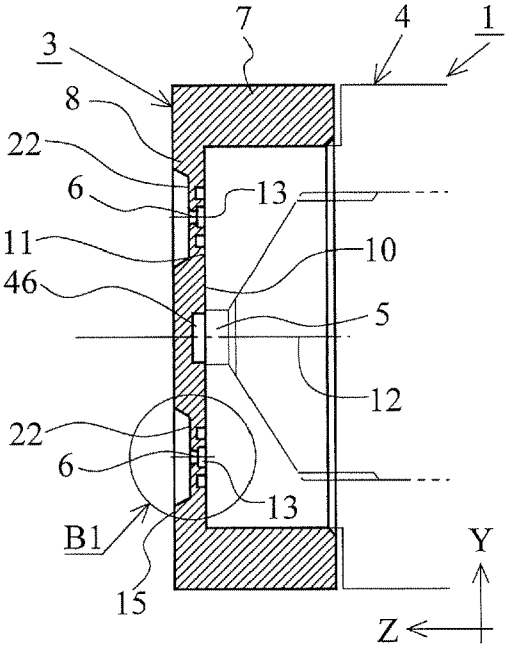
FIG. 2B is a cross-sectional view of the nozzle plate taken along a line A1-A1 in FIG. 2A.
Figure 2A:
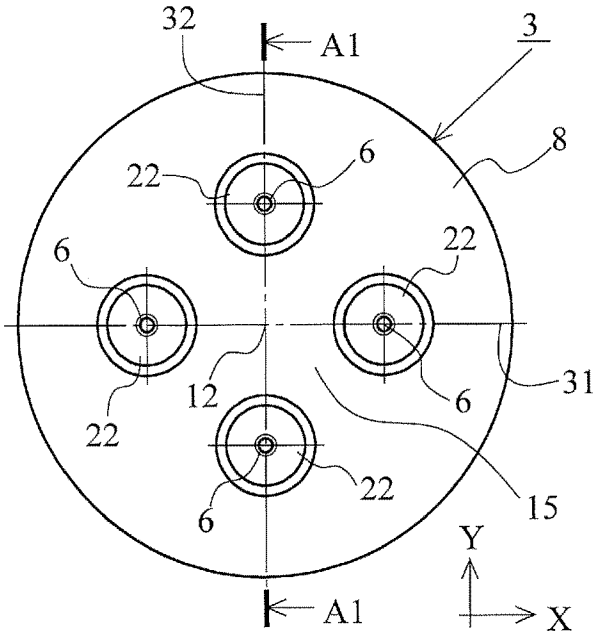
FIG. 2A is a front view of the nozzle plate.

FIG. 2 and FIG. 3 are views showing a nozzle plate 3 according to the first embodiment of the present invention. FIG. 2A is a front view of the nozzle plate 3, FIG. 2B is a cross-sectional view of the nozzle plate 3 taken along a line A1-A1 in FIG. 2A, and FIG. 2C is a back view of the nozzle plate 3. FIG. 3A is an enlarged view of a part of a nozzle plate 3 (periphery of the nozzle holes 6) shown in FIG. 2A, FIG. 3B is an enlarged cross-sectional view of a portion B1 of FIG. 2B (cross-sectional view taken along a line A2-A2 in FIG. 3A), FIG. 3C is a right side view of FIG. 3B (enlarged view of a vicinity of a swirl chamber 13 in FIG. 2C), and FIG. 3D is an enlarged cross-sectional view of a portion B2 in FIG. 3B.

As shown in FIG. 2, the nozzle plate 3, which is mounted on a distal end of a valve body 4 of the fuel injection device 1, is configured to spray the fuel injected from a fuel injection port 5 of the valve body 4 from a plurality of (four in this embodiment) nozzle holes 6 to a side of the intake pipe 2. This nozzle plate 3 is a bottomed cylindrical body made of a synthetic resin material (for example, PPS, PEEK, POM, PA, PES, PEI, and LCP) which is constituted of a circular cylindrical fitted portion 7 and a plate body portion 8 which is integrally formed with one end side of the circular cylindrical fitted portion 7. Then, the circular cylindrical fitted portion 7 of the nozzle plate 3 is fitted on an outer periphery of the valve body 4 on a distal end side without a gap, and is fixed to the valve body 4 in a state where an inner surface 10 of the plate body portion 8 is brought into contact with a distal end surface 11 of the valve body 4.

The plate body portion 8, which is formed into a circular-plate shape, has a center axis 12. On an identical circumference around the center axis 12, a plurality of (four) nozzle holes 6 are formed at regular intervals. This nozzle hole 6 is formed such that one end (fuel inflow-side opening end) 6*a* opens into a bottom surface 14 of a swirl chamber 13 formed at a side of the surface (inner surface) 10 opposed to the fuel injection port 5 of the plate body portion 8 and the other end (fuel outflow-side opening end) 6*b* opens at a side of an outer surface 15 (a surface positioned at a side opposed to the inner surface 10) of the plate body portion 8. When the inner surface 10 of the plate body portion 8 is viewed in plan view, the nozzle hole 6 is formed as positioned at a middle 17 of an imaginary straight line 16 that couples a center 26*a* of a first elliptical-shaped recessed portion 26 to a center 27*a* of a second elliptical-shaped recessed portion 27, which are described later (formed at a position that bisects the imaginary straight line 16). Then, the nozzle hole 6 is coupled to the fuel injection port 5 of the valve body 4 via the swirl chamber 13, and first and second fuel guide channels 18 and 20. Therefore, the fuel injected from the fuel injection port 5 is introduced into the nozzle hole 6 via the first and second fuel guide channels 18 and 20 and the swirl chamber 13.

At the side of the outer surface 15 of the plate body portion 8, bottomed recesses 22 that are concentric with centers of the nozzle holes 6 are formed. This recess 22 is formed such that a bottom surface 23 has an outside diameter larger than that of the nozzle hole 6, and a taper-shaped inner surface 24 expands from the bottom surface 23 toward an outward of the bottomed recess 22. This recess 22 is formed such that the spray generated by injecting the fuel from the nozzle hole 6 does not impinge on the taper-shaped inner surface 24. The bottom surface 23 of the recess 22 constitutes a part of the outer surface 15 of the plate body portion 8.

As shown in FIG. 2 and FIG. 3, the swirl chamber 13 has a shape as formed by combining the first elliptical-shaped recessed portion 26, which is a recess formed at the inner surface 10 side of the plate body portion 8 (at a side of a surface opposed to the fuel injection port 5), with the second elliptical-shaped recessed portion 27, which is a recess that has a size identical to a size of the first elliptical-shaped recessed portion 26 (has an identical planar shape and an identical depth from the inner surface 10). Then, a long axis 28 of the first elliptical-shaped recessed portion 26 and a long axis 30 of the second elliptical-shaped recessed portion 27 are positioned on a center line 31, which passes through a center of the plate body portion 8 and is parallel to the X-axis, or a center line 32, which passes through the center of the plate body portion 8 and is parallel to a Y-axis. That is, the long axis 30 of the second elliptical-shaped recessed portion 27 is disposed on an extended line of the long axis 28 of the first elliptical-shaped recessed portion 26 (on the center line 31 or on the center line 32), and the center 27*a* (an intersection point of the long axis 30 and a short axis 34) of the second elliptical-shaped recessed portion 27 is disposed displaced from the center 26*a* (an intersection point of the long axis 28 and a short axis 33) of the first elliptical-shaped recessed portion 26 by a predetermined dimension (ε1). Then, at this swirl chamber 13, the first elliptical-shaped recessed portion 26 partially overlaps with the second elliptical-shaped recessed portion 27, the first fuel guide channel 18 opens at an end portion side of the long axis 28 of the first elliptical-shaped recessed portion 26 that does not overlap with the second elliptical-shaped recessed portion 27, and the second fuel guide channel 20 opens at an end portion side of the long axis 30 of the second elliptical-shaped recessed portion 27 and at an end portion side of the long axis 30 of the second elliptical-shaped recessed portion 27 that does not overlap with the first elliptical-shaped recessed portion 26.

As shown in FIG. 3, the first elliptical-shaped recessed portion 26 of the swirl chamber 13 has a sidewall 35 coupled to a channel sidewall 36 of the second fuel guide channel 20 near the first elliptical-shaped recessed portion 26 by a smooth curved surface 37 (a curved surface whose shape in plan view is a semicircle that is convex inward the swirl chamber 13). This curved surface 37 is coupled to the sidewall 35 of the first elliptical-shaped recessed portion 26 on the long axis 30 of the second elliptical-shaped recessed portion 27, and is coupled to the channel sidewall 36 of the second fuel guide channel 20 near the first elliptical-shaped recessed portion 26 on the long axis 30 of the second elliptical-shaped recessed portion 27. The second elliptical-shaped recessed portion 27 of the swirl chamber 13 has a sidewall 38 coupled to a channel sidewall 40 of the first fuel guide channel 18 near the second elliptical-shaped recessed portion 27 by a smooth curved surface 41 (a curved surface whose shape in plan view is a semicircle that is convex inward the swirl chamber 13). This curved surface 41 is coupled to the sidewall 38 of the second elliptical-shaped recessed portion 27 on the long axis 28 of the first elliptical-shaped recessed portion 26, and is coupled to the channel sidewall 40 of the first fuel guide channel 18 near the second elliptical-shaped recessed portion 27 on the long axis 28 of the first elliptical-shaped recessed portion 26. Accordingly, the first fuel guide channel 18 has the opening portion (coupling portion) 42 into the swirl chamber 13. The opening portion 42 is on the long axis 28 of the first elliptical-shaped recessed portion 26. The second fuel guide channel 20 has the opening portion (coupling portion) 43 into the swirl chamber 13. The opening portion 43 is on the long axis 30 of the second elliptical-shaped recessed portion 27. Then, when the swirl chamber 13 is viewed in plan view, the opening portion 42 of the first fuel guide channel 18 into the first elliptical-shaped recessed portion 26 (the swirl chamber 13) and the opening portion 43 of the second fuel guide channel 20 into the second elliptical-shaped recessed portion 27 (the swirl chamber 13) are positioned to have a dyad symmetry with respect to the middle 17 of the imaginary straight line 16. Intervals between the sidewalls 35 and 38 of the swirl chamber 13 and the nozzle hole 6 are formed to become narrowest (smallest) on the long axes 28 and 30 of the first and second elliptical-shaped recessed portions 26 and 27 (a coupling portion of the sidewall 35 to the curved surface 37, and a coupling portion of the sidewall 38 to the curved surface 41). As a result, a flow of the fuel that performs a swirling movement inside the first elliptical-shaped recessed portion 26 and the flow of the fuel that performs the swirling movement inside the second elliptical-shaped recessed portion 27 act on one another to increase a swirling velocity of the fuel inside the swirl chamber 13.

As shown in FIG. 2 and FIG. 3, the first and second fuel guide channels 18 and 20 include first fuel guide channel portions 45 coupled to the swirl chambers 13 and second fuel guide channel portions 46 that guide the fuel injected from the fuel injection ports 5 to the first fuel guide channel portions 45. The first fuel guide channel portion 45 of the first fuel guide channel 18 and the first fuel guide channel portion 45 of the second fuel guide channel 20 are formed deeper than the swirl chambers 13 and formed having identical channel depths, formed such that lengths of flow passages from coupling portions to the second fuel guide channel portions 46 (branch channel parts 46*a* of the second fuel guide channel portions 46) to the opening portions 42, 43 into the swirl chambers 13 have identical dimensions, and formed such that parts from the coupling portions to the second fuel guide channel portions 46 (the branch channel parts 46*a* of the second fuel guide channel portions 46) to the opening portions 42, 43 into the swirl chambers 13 have identical channel widths. The first fuel guide channel portion 45 coupled to one of adjacent swirl chambers 13, 13 and the first fuel guide channel portion 45 coupled to the other of the adjacent swirl chambers 13, 13 are coupled to a common second fuel guide channel portion 46. The second fuel guide channel portions 46 are formed at four positions at regular intervals radially from a middle at the inner surface 10 side of the plate body portion 8. Then, the second fuel guide channel portions 46 at four positions are formed into identical shapes. That is, the second fuel guide channel portions 46 at four positions are formed to have the identical lengths of the flow passages from the middle at the inner surface 10 side of the plate body portion 8 to the first fuel guide channel portions 45, the identical channel widths, and the identical channel depths. The pair of branch channel parts 46*a*, 46*a* of the second fuel guide channel portion 46 have linearly symmetrical shapes with respect to a center line 46*b* of the channel width of the second fuel guide channel portion 46 as a symmetry axis. Such first and second fuel guide channels 18 and 20 can flow the fuel injected from the fuel injection port 5 into the swirl chamber 13 by identical amounts.

As shown in FIG. 2 and FIG. 3, the first fuel guide channel portion 45 includes a swirl-chamber-side coupling portion 45*a* (a straight-line part) that opens into the swirl chamber 13 as being perpendicular to the long axes 28 and 30 of the swirl chamber 13, and a curved flow passage part 45*b* such that a centrifugal force in a direction away from the middle 17 of the imaginary straight line 16 acts on the fuel that flows into the swirl chamber 13. Here, when the inner surface 10 is viewed in plan view, the curved flow passage part 45*b* of the first fuel guide channel 18 coupled to the swirl chamber 13 at an inward end side in a radial direction is formed into a curved shape that is convex inward in the radial direction of the inner surface 10. When the inner surface 10 is viewed in plan view, the curved flow passage part 45*b* of the second fuel guide channel 20 coupled to the swirl chamber 13 at an outward end side in the radial direction is formed into a curved shape that is convex outward in the radial direction of the inner surface 10. As a result, the fuel flowed into the swirl chamber 13 from the first fuel guide channel 18 and the second fuel guide channel 20 has a sufficient amount to swirl along the shapes of the sidewalls 35 and 38 of the swirl chamber 13.

As shown in FIG. 2 and FIG. 3, the first and second fuel guide channels 18 and 20 are disposed to extend to an inside of the swirl chamber 13 from the opening portions 42 and 43 into the swirl chamber 13. That is, the first fuel guide channel 18 includes the part (the first in-swirl-chamber fuel guide channel portion) 47 disposed to extend while gradually reducing the channel width (channel cross-sectional area) from the opening portion 42 into the first elliptical-shaped recessed portion 26 to an inside of the first elliptical-shaped recessed portion 26 along the sidewall 35 of the first elliptical-shaped recessed portion 26. Also, the second fuel guide channel 20 includes the part (the second in-swirl-chamber fuel guide channel portion) 48 disposed to extend while gradually reducing the channel width (channel cross-sectional area) from the opening portion 43 into the second elliptical-shaped recessed portion 27 to an inside of the second elliptical-shaped recessed portion 27 along the sidewall 38 of the second elliptical-shaped recessed portion 27. Then, when the swirl chamber 13 is viewed in plan view, the first in-swirl-chamber fuel guide channel portion 47 and the second in-swirl-chamber fuel guide channel portion 48 are formed to have a dyad symmetry with respect to the middle 17 of the imaginary straight line 16. When these first in-swirl-chamber fuel guide channel portion 47 and second in-swirl-chamber fuel guide channel portion 48 are viewed in plan view, internal surfaces 50 at a side of the nozzle hole 6 have smooth arc shapes (arc shapes that are convex in directions identical to the sidewalls 35 and 38). Such first and second in-swirl-chamber fuel guide channel portions 47 and 48 improve the flow, in a tangential direction of the nozzle hole 6, of the fuel supplied into the swirl chamber 13 from the first fuel guide channel portions 45, 45 to reduce the flow in a normal direction toward the nozzle hole 6, thus guiding the fuel into the inside of the swirl chamber 13 along the sidewalls 35 and 38 of the swirl chamber 13. Then, the flow of the fuel from sides of the first and second in-swirl-chamber fuel guide channel portions 47 and 48 toward the nozzle hole 6 is narrowed down to accelerate by the first and second in-swirl-chamber fuel guide channel portions 47 and 48, which are configured to gradually reduce the channel width, since the first and second in-swirl-chamber fuel guide channel portions 47 and 48 are formed deeper than the swirl chamber 13 (having depths identical to those of the first and second fuel guide channels 18 and 20).

Also, as shown in FIG. 3, the nozzle hole 6 is divided into a portion near fuel-inflow end 51 and a portion near fuel-outflow end 52. The portion near fuel-inflow end 51 of the nozzle hole 6 is a round hole 53 that opens so as to be perpendicular to a bottom surface 14 of the swirl chamber 13, and is formed so as to have the same inner diameter consistently from the fuel inflow-side opening end 6*a* to a portion near fuel-outflow end 52. Also, the portion near fuel-outflow end 52 of the nozzle hole 6 is formed of a curved surface 54 that is convex toward a center of the nozzle hole 6, and is formed so as to smoothly and gradually increase a flow passage cross-sectional area from an upstream end 55 connected to the portion near fuel-inflow end 51 (upstream end viewed in a fuel flow direction) to the fuel outflow-side opening end 6*b*. Then, the curved surface 54 has a quarter-arc shape which is an arc of a quadrant of perfect circle in a cross-sectional view shown in FIG. 3D, a tangential direction along a bus-bar direction at an upstream end 55 connected to a portion near fuel-inflow end 51 corresponds to a bus-bar direction of the round hole 53 of the portion near fuel-inflow end 51, and a tangential direction along a bus-bar direction of the fuel outflow-end-side opening end 6*b* is a direction (direction along the Y-axis in FIG. 3D) along an outer surface 15 (the bottom surface 23 of the recess 22) of the plate body portion 8. As a result, in the curved surface 54, the upstream end 55 is smoothly connected (without forming an edge or level gap) to an inner surface of the round hole 53, and the fuel outflow-side opening end 6*b* is smoothly connected (without forming an edge) to an outer surface 15 (the bottom surface 23 of the recess 22) of the plate body portion 8. The curved surface 54 of the nozzle hole 6 formed as such can form a thin film-like flow by expanding the flow of the fuel flowed from the swirl chamber 13 into the round hole 53 of the nozzle hole 6 by means of Coanda effect.

In a nozzle plate 3 configured as such according to the present invention, the fuel flowed from the first and second fuel guide channels 18, 20 into the swirl chamber 13 is guided to the nozzle hole 6 while swirling in the swirl chamber 13 in the identical direction, the fuel flowing swirlingly in the round hole 53 of the nozzle hole 6 generates a flow along the curved surface 54 of the nozzle hole 6 by means of Coanda effect, thus expanding the fuel flow by the curved surface 54 to form a thin film-like flow. As a result, a nozzle plate 3 according to the present embodiment sufficiently spreads the spray generated by injection of fuel from a nozzle hole 6, ensures further minute fuel microparticles in spraying compared to conventional examples, and ensures the further homogeneous fuel microparticles in spraying compared to conventional examples.

According to the nozzle plate 3 according to the embodiment, the fuel introduced into the inside of the swirl chamber 13 by the first and second fuel guide channels 18 and 20 is flowed and narrowed down in the directions (the identical swirling directions) along the sidewalls 35 and 38 of the swirl chamber 13 by the parts positioned in the swirl chamber 13 (the first and second in-swirl-chamber fuel guide channel portions 47 and 48) among the first and second fuel guide channels 18 and 20 to increase a flow rate. Furthermore, in the swirl chamber 13, the fuel from the first fuel guide channel 18 and the fuel from the second fuel guide channel 20 act on one another when swirling in the identical direction to increase the swirling velocity and a swirling force. Accordingly, the nozzle plate 3 according to the embodiment, compared to a nozzle plate where first and second fuel guide channels 18 and 20 are not disposed to extend to an inside of a swirl chamber 13 and a nozzle plate of a conventional example, can effectively reduce variation of spray generated by injection of the fuel from the nozzle hole 6 since an effect of increase in a velocity component in the swirling direction of the fuel that passes through the nozzle hole 6 in combination with an effect of the curved surface 54 of the nozzle hole 6 can ensure a further thinned fuel flow in the nozzle hole 6, thus ensuring further fine and homogeneous spray.

Also, in the nozzle plate 3 according to the present embodiment, the upstream end 55 of the curved surface 54 of the nozzle hole 6 is smoothly connected (without forming an edge or level gap) to the inner surface of the round hole 53 of the nozzle hole 6. With this configuration, a loss of swirling energy of the fuel caused by a sudden change in the flow passage cross-sectional shape of the nozzle hole 6 can be reduced, thus improving Coanda effect by the curved surface 54 of the nozzle hole 6 compared to the case of a sudden change in the flow passage cross-sectional shape of the nozzle hole 6.

(Modification 1)

Figure 4C:
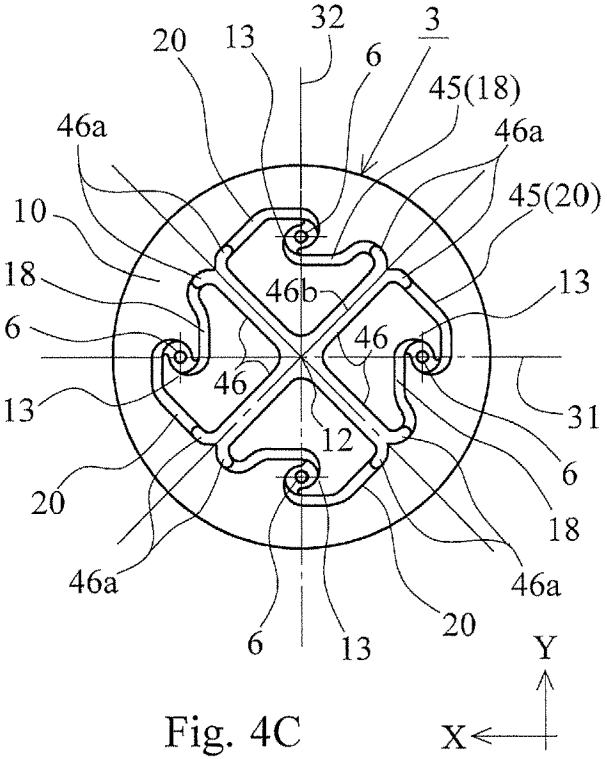
FIG. 4C is a back surface view of the nozzle plate.
Figure 4B:
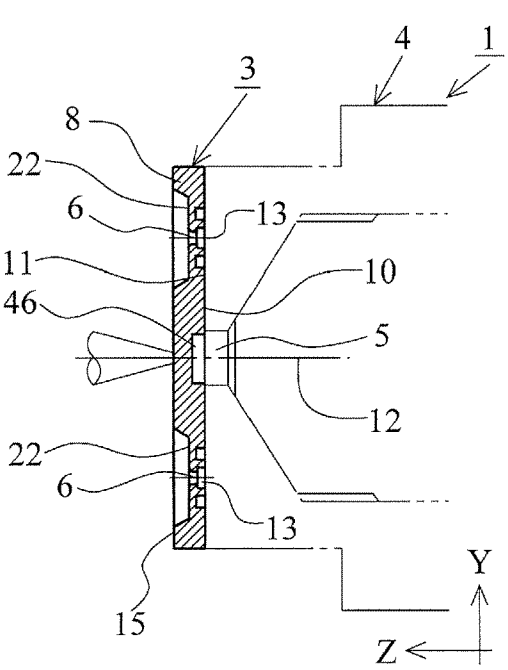
FIG. 4B is a cross-sectional view of the nozzle plate taken along a line A3-A3 in FIG. 4A.
Figure 4A:
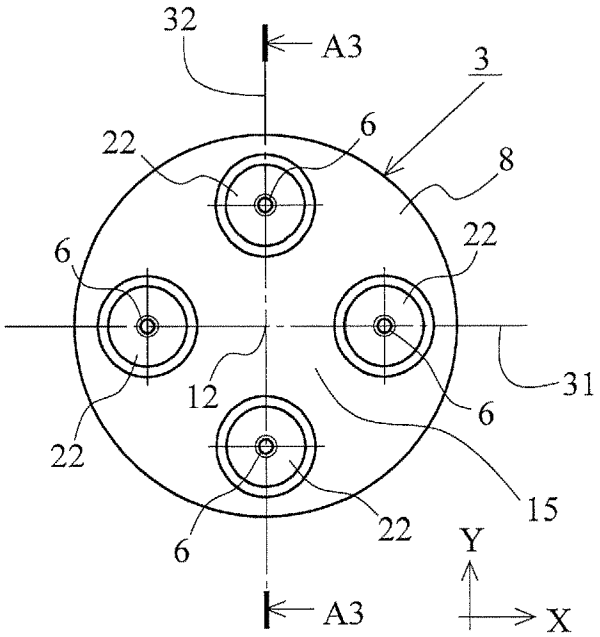
FIG. 4A is a plan view of the nozzle plate.

FIG. 4 are views showing a nozzle plate 3 according to the modification. FIG. 4A is a plan view of the nozzle plate 3, FIG. 4B is a cross-sectional view of the nozzle plate 3 taken along a line A3-A3 in FIG. 4A, and FIG. 4C is a back surface view of the nozzle plate 3. It is to be noted that, in the nozzle plate 3 of the present modification, the same reference characters as those in the nozzle plate 3 according to the first embodiment are used to represent the same component, and redundant description of already described nozzle plate 3 according to the first embodiment is omitted.

As shown in FIG. 4, the nozzle plate 3 according to the modification has a shape where the circular cylindrical fitted portion 7 of the nozzle plate 3 according to the first embodiment is omitted, and is constituted of only a part corresponding to the plate body portion 8 of the nozzle plate 3 according to the first embodiment. Other configuration of the nozzle plate 3 according to the modification is similar to that of the nozzle plate 3 according to the first embodiment. That is, at the nozzle plate 3 according to the modification, configurations of the nozzle hole 6, the swirl chamber 13, and the first and second fuel guide channels 18 and 20 are similar to those of the nozzle plate 3 according to the first embodiment. The nozzle plate 3 according to the modification, similarly to the nozzle plate 3 according to the first embodiment, is fixed to the valve body 4 in a state where the inner surface 10 of the plate body portion 8 is brought into contact with the distal end surface 11 of the valve body 4. Such a nozzle plate 3 according to the modification can obtain an effect similar to that of the nozzle plate 3 according to the first embodiment. The nozzle plate 3 has an outer shape deformed as necessary corresponding to a shape at a distal end side of the valve body 4.

(Modification 2)

Figure 5A:
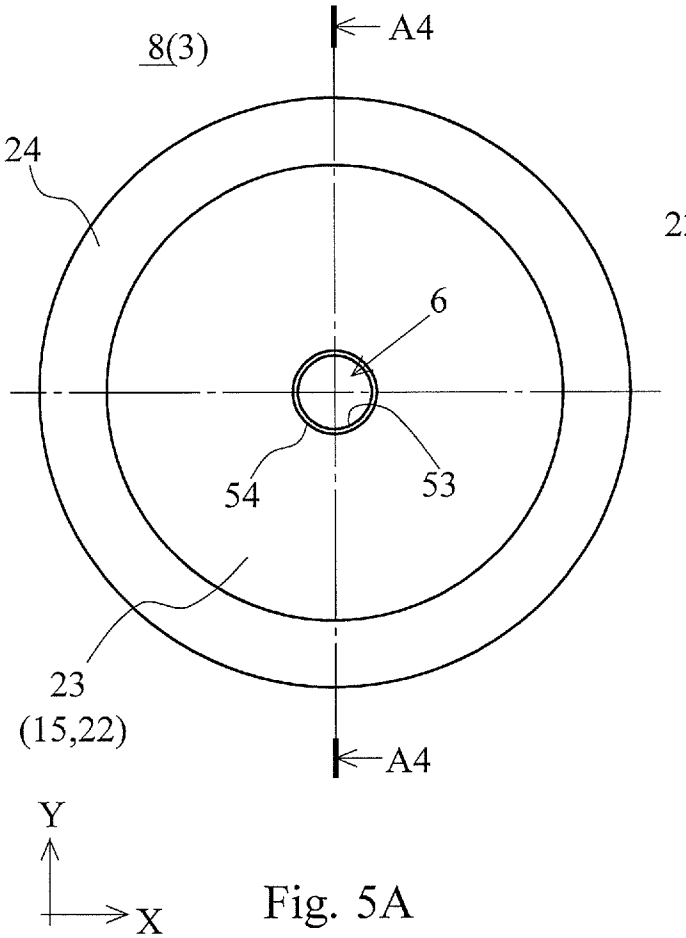
FIG. 5A is an enlarged view of a part of the nozzle plate (periphery of the nozzle holes) (corresponding to FIG. 3A)
Figure 5B:
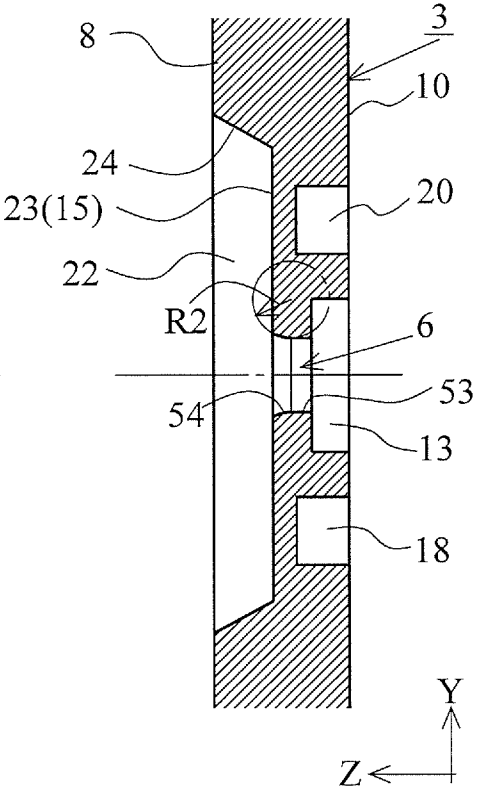
FIG. 5B is a cross-sectional view taken along a line A4-A4 in FIG. 5A (corresponding to FIG. 3B)
Figure 5C:
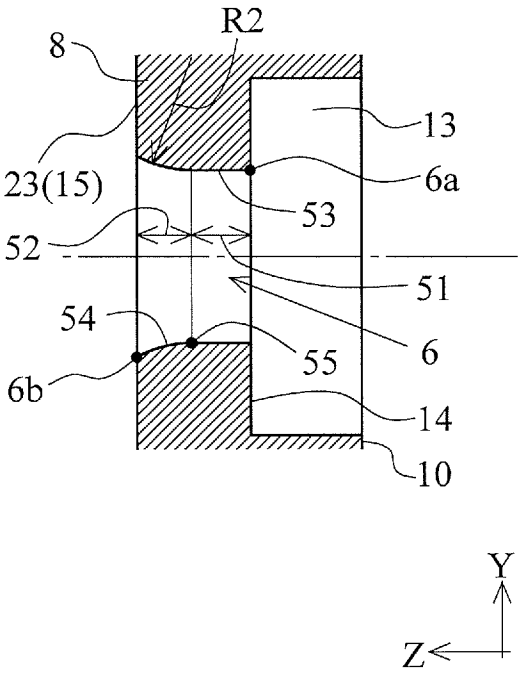
FIG. 5C is a partial enlarged view of FIG. 5B (corresponding to FIG. 3D).

FIG. 5 shows a nozzle plate 3 according to the present modification, and correspond to FIG. 3. FIG. 5A is an enlarged view of a part of the nozzle plate 3 (periphery of the nozzle holes 6) (corresponding to FIG. 3A), FIG. 5B is a cross-sectional view taken along a line A4-A4 in FIG. 5A (corresponding to FIG. 3B), and FIG. 5C is a partial enlarged view of FIG. 5B (corresponding to FIG. 3D).

Figure 3C:
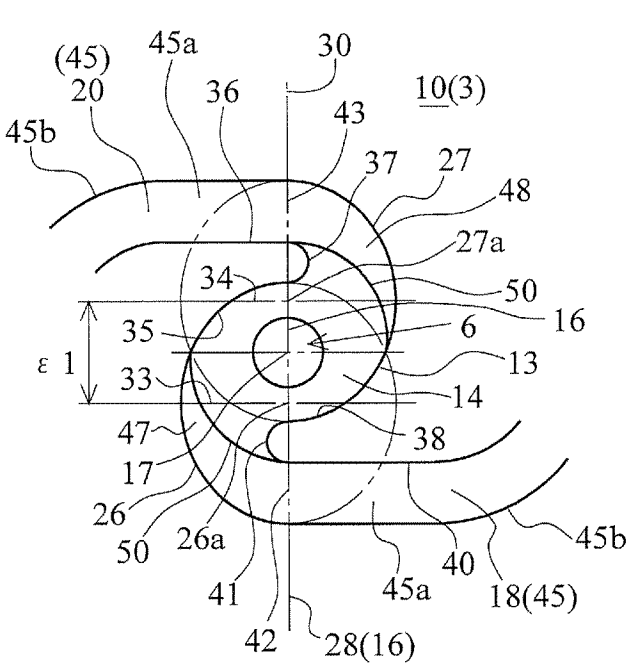
FIG. 3C is a right side view of FIG. 3B (enlarged view of a vicinity of a swirl chamber in FIG. 2C)
Figure 3B:
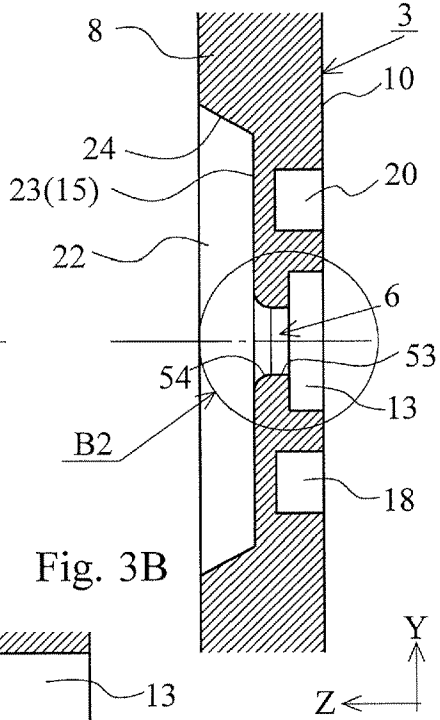
FIG. 3B is an enlarged cross-sectional view of a portion B1 of FIG. 2B (cross-sectional view taken along a line A2-A2 in FIG. 3A)
Figure 3A:
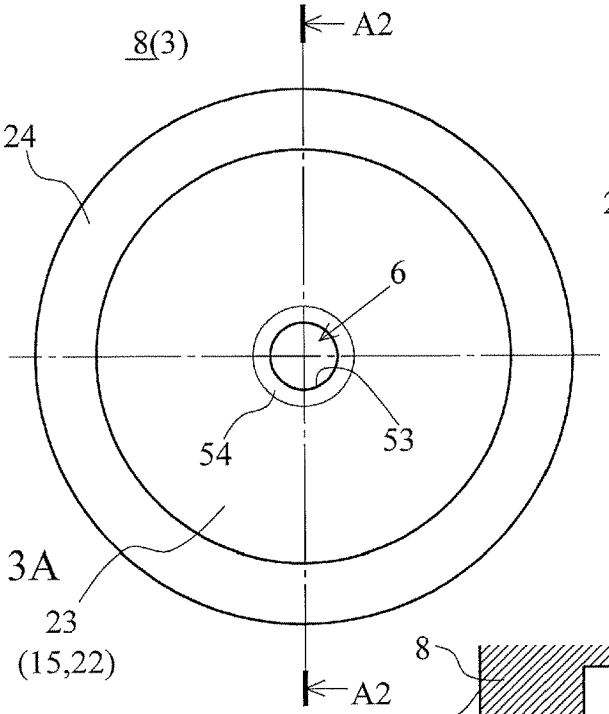
FIG. 3A is an enlarged view of a part of a nozzle plate 3 (periphery of the nozzle holes 6) shown in FIG. 2A.
Figure 3D:
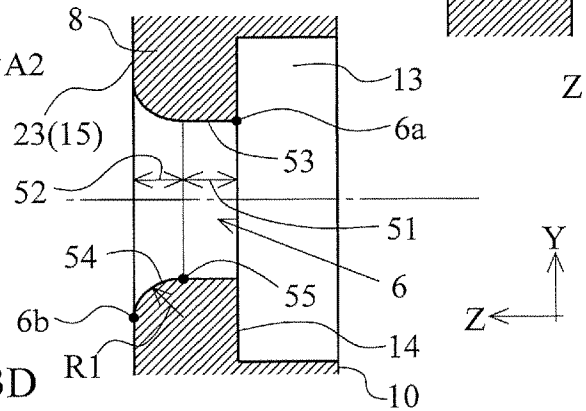
FIG. 3D is an enlarged cross-sectional view of a portion B2 in FIG. 3B.

At the nozzle plate 3 according to the present modification shown in FIG. 5, configurations of the swirl chamber 13 and the first and second fuel guide channels 18 and 20 are similar to those shown in FIG. 3C. Also, a configuration of a portion near fuel-inflow end 51 of the nozzle hole 6 is similar to those shown in FIG. 3D. However, a configuration of the curved surface 54 of the portion near fuel-outflow end of the nozzle hole 6 in the nozzle plate 3 according to the present modification is different from that of the nozzle plate 3 according to the first embodiment.

That is, in the nozzle plate 3 according to the present modification, as shown in FIGS. 5B-C, the curved surface 54 of the portion near fuel-outflow end 52 of the nozzle hole 6 is formed in a circular arc having a radius of curvature R2 larger than the radius of curvature R1 (R2>R1) of the curved surface 54 of the nozzle plate 3 according to the first embodiment and being convex toward a center of the nozzle hole 6. Then, the curved surface 54 is formed so as to smoothly and gradually increase a flow passage cross-sectional area from the upstream end 55 connected to the portion near fuel-inflow end 51 (upstream end viewed in a fuel flow direction) to the fuel outflow-end-side opening end 6*b*. Also, in a cross-sectional view shown in FIG. 5C, in the curved surface 54, a tangential direction along a bus-bar direction at an upstream end 55 connected to a portion near fuel-inflow end 51 corresponds to a bus-bar direction of the round hole 53 of the portion near fuel-inflow end 51, and a tangential direction along a bus-bar direction of the fuel outflow-end-side opening end 6*b* intersects in an oblique direction with respect to the outer surface 15 (the bottom surface 23 of the recess 22) of the plate body portion 8. As a result, at the curved surface 54, the upstream end 55 is smoothly connected (without forming an edge or level gap) to an inner surface of the round hole 53. The curved surface 54 of the nozzle hole 6 formed as such can form a thin film-like flow by expanding the flow of the fuel flowed from the swirl chamber 13 into the round hole 53 of the nozzle hole 6 by means of Coanda effect. Also, the curved surface 54 of the nozzle hole according to the present modification can narrow a spread of spray compared to the curved surface 54 of the nozzle plate 3 according to the first embodiment. In the nozzle plate according to the present modification, the spread of spray can be narrowed by increasing the radius of curvature R2 of the curved surface 54, and the spread of spray can be expanded by bringing the radius of curvature R2 of the curved surface 54 closer to R1.

A nozzle plate 3 according to the present modification as mentioned above sufficiently spreads the spray generated by injection of fuel from a nozzle hole 6, ensures further minute fuel microparticles in spraying compared to conventional examples, and ensures the further homogeneous fuel microparticles in spraying compared to conventional examples.

(Modification 3)

Figure 6A:
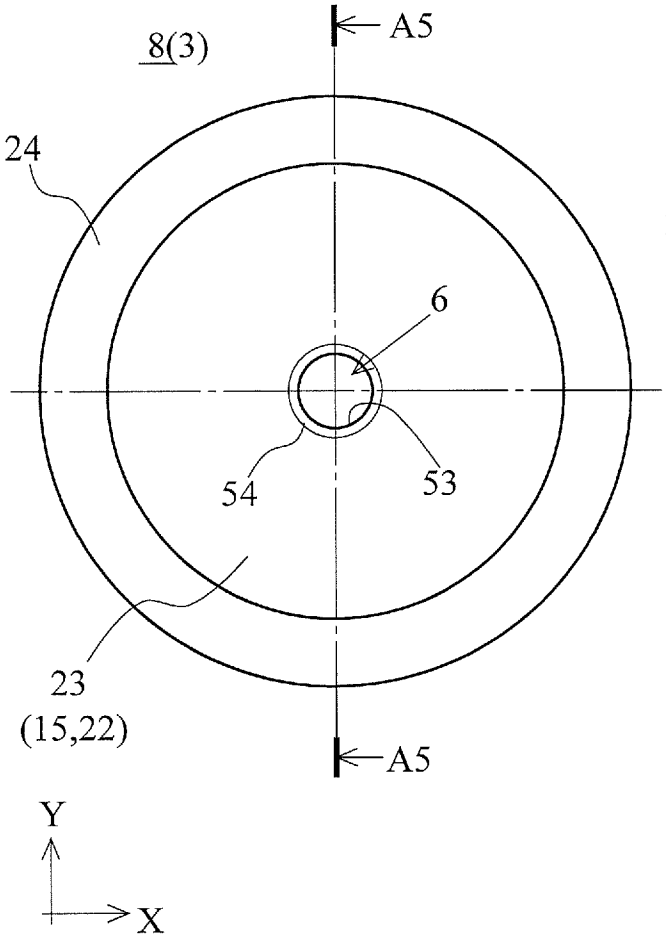
FIG. 6A is an enlarged view of a part of the nozzle plate (periphery of the nozzle holes) (corresponding to FIG. 3A)
Figure 6B:
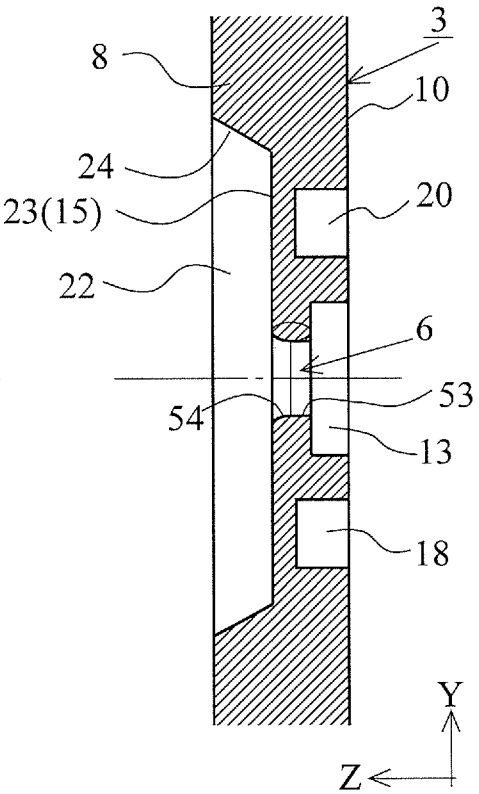
FIG. 6B is a cross-sectional view taken along a line A5-A5 in FIG. 6A (corresponding to FIG. 3B)
Figure 6C:
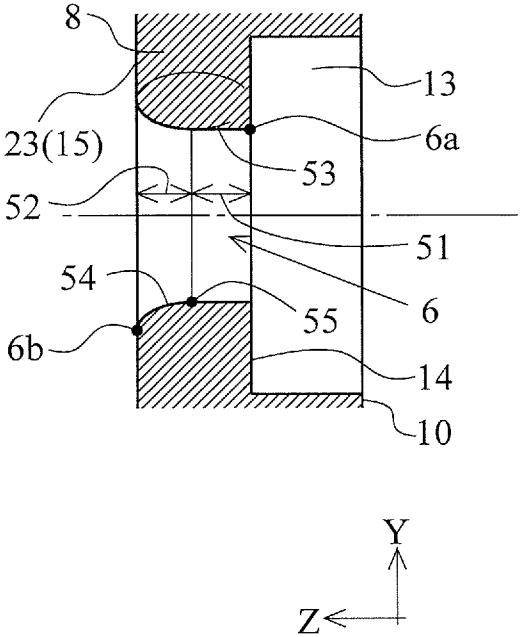
FIG. 6C is a partial enlarged view of FIG. 6B (corresponding to FIG. 3D).

FIG. 6 shows a nozzle plate 3 according to the present modification, and correspond to FIG. 3. FIG. 6A is an enlarged view of a part of the nozzle plate 3 (periphery of the nozzle holes 6) (corresponding to FIG. 3A), FIG. 6B is a cross-sectional view taken along a line A5-A5 in FIG. 6A (corresponding to FIG. 3B), and FIG. 6C is a partial enlarged view of FIG. 6B (corresponding to FIG. 3D).

At the nozzle plate 3 according to the present modification shown in FIG. 6, configurations of the swirl chamber 13 and the first and second fuel guide channels 18 and 20 are similar to those shown in FIG. 3C. Also, a configuration of a portion near fuel-inflow end 51 of the nozzle hole 6 is similar to those shown in FIG. 3D. However, a configuration of the curved surface 54 of the portion near fuel-outflow end 52 of the nozzle hole 6 in the nozzle plate 3 according to the present modification is different from that of the nozzle plate 3 according to the first embodiment.

That is, in the nozzle plate 3 according to the present modification, the curved surface 54 of the portion near fuel-outflow end 52 of the nozzle hole 6 is formed in an elliptical arc (arc of quadrant) that is convex toward a center of the nozzle hole 6, as shown in FIGS. 6B-C. Then, the curved surface 54 is formed so as to smoothly and gradually increase a flow passage cross-sectional area from the upstream end 55 connected to the portion near fuel-inflow end 51 (upstream end viewed in a fuel flow direction) to the fuel outflow-end-side opening end 6*b*. Also, in a cross-sectional view shown in FIG. 6C, in the curved surface 54, a tangential direction along a bus-bar direction at an upstream end 55 connected to a portion near fuel-inflow end 51 corresponds to a bus-bar direction of the round hole 53 of the portion near fuel-inflow end 51, and a tangential direction along a bus-bar direction of the fuel outflow-end-side opening end 6*b* is along the outer surface 15 (the bottom surface 23 of the recess 22) of the plate body portion 8. As a result, at the curved surface 54, the upstream end 55 is smoothly connected (without forming an edge or level gap) to an inner surface of the round hole 53, and the fuel outflow-side opening end 6*b* is smoothly connected to an outer surface 15 (the bottom surface 23 of the recess 22) of the plate body portion 8. The curved surface 54 of the nozzle hole 6 formed as such can form a thin film-like flow by expanding the flow of the fuel flowed from the swirl chamber 13 into the round hole 53 of the nozzle hole 6 by means of Coanda effect. Also, in the curved surface 54 of the nozzle hole according to the present modification, a spread level of spray can be changed by changing a length of long axis and short axis of an elliptical circle.

A nozzle plate 3 according to the present modification as mentioned above sufficiently spreads the spray generated by injection of fuel from a nozzle hole 6, ensures further minute fuel microparticles in spraying compared to conventional examples, and ensures the further homogeneous fuel microparticles in spraying compared to conventional examples.

(Modification 4)

Figure 7C:
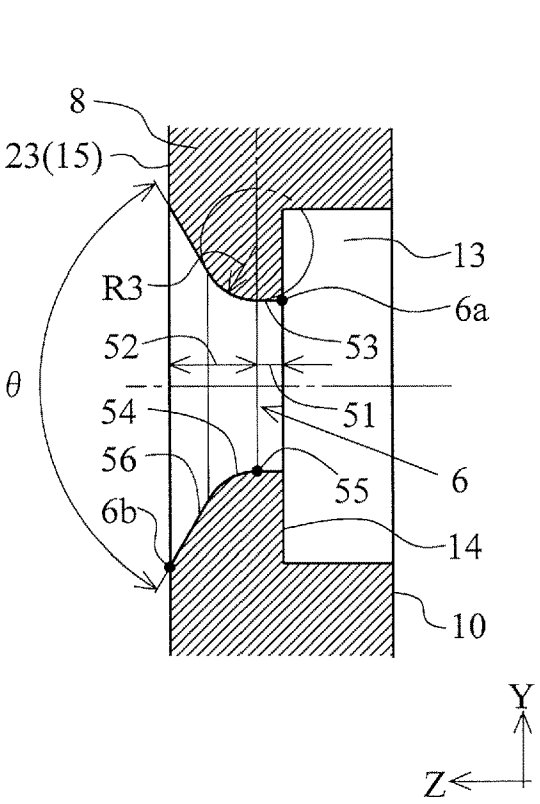
FIG. 7C is a partial enlarged view of FIG. 7B (corresponding to FIG. 3D).
Figure 7B:
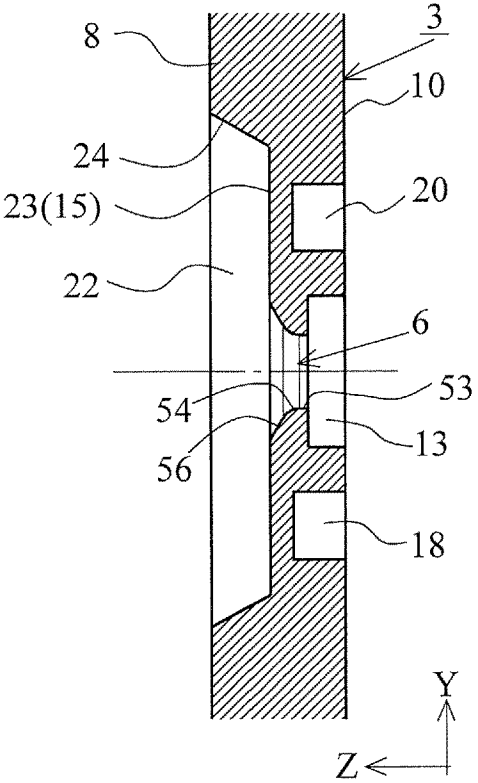
FIG. 7B is a cross-sectional view taken along a line A6-A6 in FIG. 7A (corresponding to FIG. 3B)
Figure 7A:
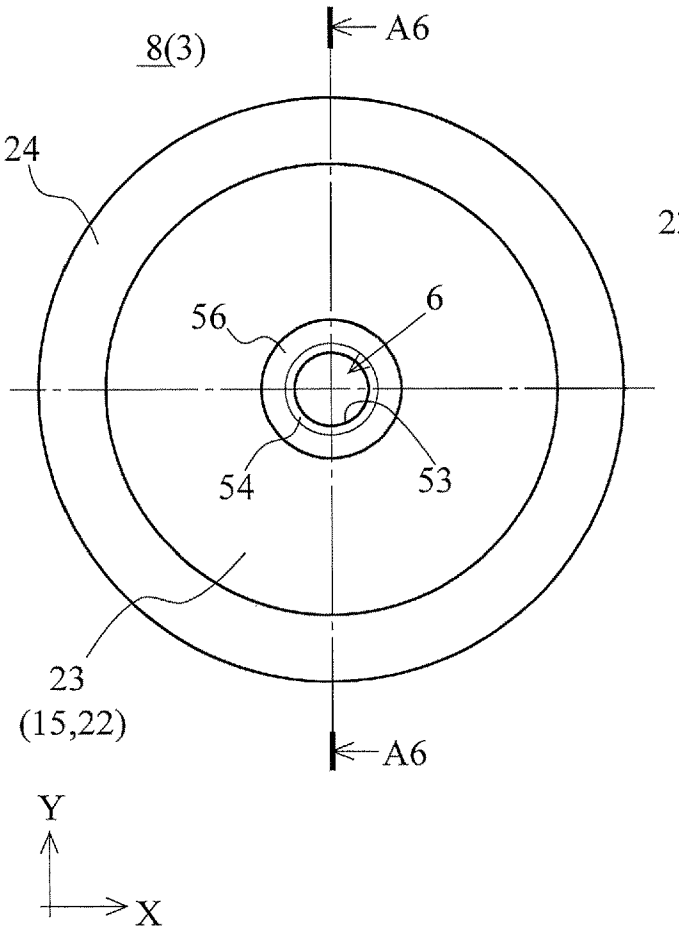
FIG. 7A is an enlarged view of a part of the nozzle plate (periphery of the nozzle holes) (corresponding to FIG. 3A)

FIG. 7 shows a nozzle plate 3 according to the present modification, and correspond to FIG. 3. FIG. 7A is an enlarged view of a part of the nozzle plate 3 (periphery of the nozzle holes 6) (corresponding to FIG. 3A), FIG. 7B is a cross-sectional view taken along a line A6-A6 in FIG. 7A (corresponding to FIG. 3B), and FIG. 7C is a partial enlarged view of FIG. 7B (corresponding to FIG. 3D).

At the nozzle plate 3 according to the present modification shown in FIG. 7, configurations of the swirl chamber 13 and the first and second fuel guide channels 18 and 20 are similar to those shown in FIG. 3C. However, a configuration of the nozzle hole 6 in the nozzle plate 3 according to the present modification is different from that of the nozzle plate 3 according to the first embodiment.

That is, a length of the cavity 53 of the portion near fuel-inflow end 51 of the nozzle hole 6 in the nozzle plate 3 according to the present modification is made shorter than the length of the cavity 53 of the nozzle plate 3 according to the first embodiment. Also, in the portion near fuel-outflow end 52 of the nozzle hole 6, the inner surface of the nozzle hole 6 at upstream end side of the fuel flow direction is the curved surface 54, and an inner surface of the nozzle hole 6 at downstream end side of the fuel flow direction is a tapered surface 56 smoothly connected to the curved surface 54. The curved surface 54 is shaped in a circular arc (circular arc having radius of curvature R3) convex toward a center of the nozzle hole 6, and is formed so as to smoothly and gradually increase a flow passage cross-sectional area from an upstream end 55 connected to the round hole 53 of the portion near fuel-inflow end 51 (upstream end viewed in a fuel flow direction) to a tapered surface 56. Also, in a cross-sectional view shown in FIG. 7C, in the curved surface 54, a tangential direction along a bus-bar direction at an upstream end 55 corresponds to a bus-bar direction of the round hole 53 of the portion near fuel-inflow end 51, and a tangential direction along a bus-bar direction of a downstream end corresponds to a bus-bar direction of the tapered surface 56. In the tapered surface 56, in a cross-sectional view in FIG. 7C, the upstream end in the fuel flow direction is smoothly connected to the downstream end of the curved surface 54, and the flow passage cross-sectional area is configured to gradually increase from the upstream end to the downstream end in the fuel flow direction. The curved surface 54 and the tapered surface 56 of the nozzle hole 6 formed as such can form a thin film-like flow by expanding the flow of the fuel flowed from the swirl chamber 13 in a swirling manner into the round hole 53 of the nozzle hole 6 by means of Coanda effect. In the nozzle plate according to the present modification, a spread level of spray can be changed by changing the radius of curvature R3 of the curved surface 54 and a taper angle (θ) of the tapered surface 56.

A nozzle plate 3 according to the present modification as mentioned above sufficiently spreads the spray generated by injection of fuel from a nozzle hole 6, ensures further minute fuel microparticles in spraying compared to conventional examples, and ensures the further homogeneous fuel microparticles in spraying compared to conventional examples.

(Modification 5)

Figure 8C:
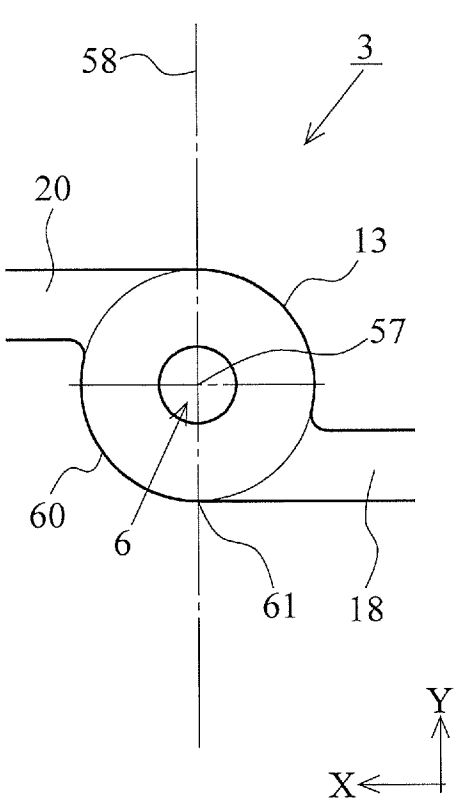
FIG. 8C is a right side view of FIG. 8B (corresponding to FIG. 3C).
Figure 8B:
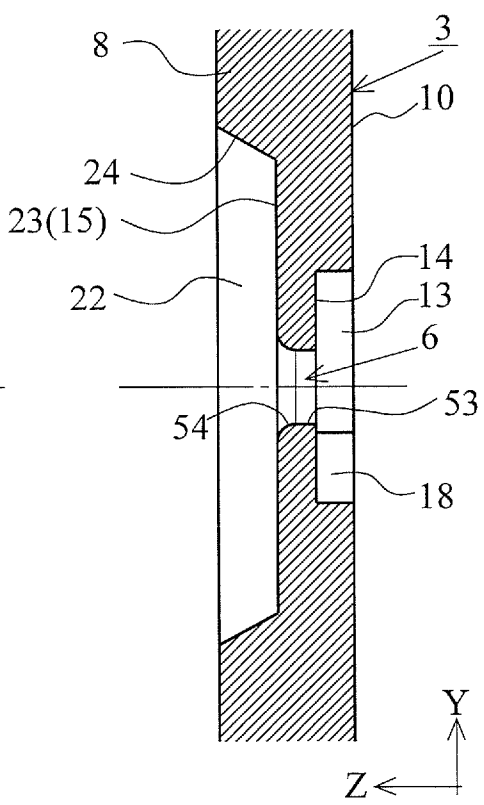
FIG. 8B is a cross-sectional view taken along a line A7-A7 in FIG. 8A (corresponding to FIG. 3B)
Figure 8A:
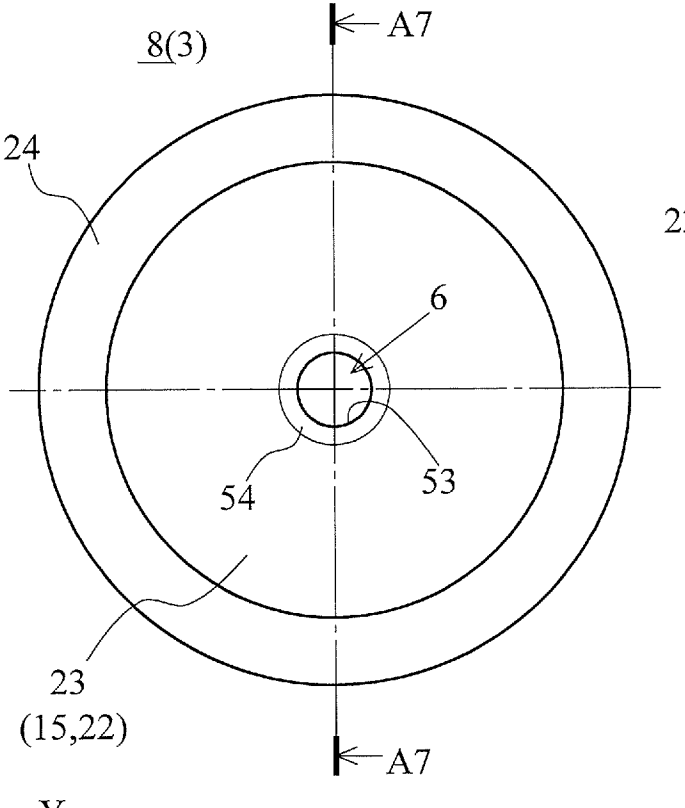
FIG. 8A is an enlarged view of a part of the nozzle plate (periphery of the nozzle holes) (corresponding to FIG. 3A)

FIG. 8 shows a nozzle plate 3 according to the present modification, and corresponds to FIG. 3. FIG. 8A is an enlarged view of a part of the nozzle plate 3 (periphery of the nozzle holes 6) (corresponding to FIG. 3A), FIG. 8B is a cross-sectional view taken along a line A7-A7 in FIG. 8A (corresponding to FIG. 3B), and FIG. 8C is a right side view of FIG. 8B (corresponding to FIG. 3C).

At the nozzle plate 3 according to the present modification shown in FIG. 8, a configuration of the nozzle hole 6 is identical to that of the nozzle hole 6 of the nozzle plate 3 according to the first embodiment (the configuration of the nozzle hole 6 shown in FIGS. 3B, D), and configurations of the swirl chamber 13 and the first and second fuel guide channels 18 and 20 are different from those of the nozzle plate 3 according to the first embodiment (the configurations shown in FIG. 3C).

That is, in the nozzle plate 3 according to the present modification, the swirl chamber 13 is formed in a circular shape which is concentric with the nozzle hole 6. Also, the first fuel guide channel 18 is formed so as to extend in the X-axis direction from an intersection point 61 where a center line 58 passing a center 57 of the swirl chamber 13 and in parallel with the Y-axis intersects with an outer edge 60 of the swirl chamber 13. Also, the second fuel guide channel 20 is in a shape of the first fuel guide channel 18 rotated at 180° about the center 57 of the swirl chamber 13. Further, the swirl chamber 13, the first fuel guide channel 18, and the second fuel guide channel 20 are shaped in the same depth dimension.

In such a nozzle plate 3 according to the present modification, the fuel flowed from the first and second fuel guide channels 18, 20 into the swirl chamber 13 is guided to the nozzle hole 6 while swirling in the swirl chamber 13 in the identical direction, the fuel flowing swirlingly in the round hole 53 of the nozzle hole 6 generates a flow along the curved surface 54 of the nozzle hole 6 by means of Coanda effect, thus expanding the fuel flow by the curved surface 54 to form a thin film-like flow. As a result, a nozzle plate 3 according to the present modification sufficiently spreads the spray generated by injection of fuel from a nozzle hole 6, ensures further minute fuel microparticles in spraying compared to conventional examples, and ensures the further homogeneous fuel microparticles in spraying compared to conventional examples.

(Modification 6)

Figure 9C:
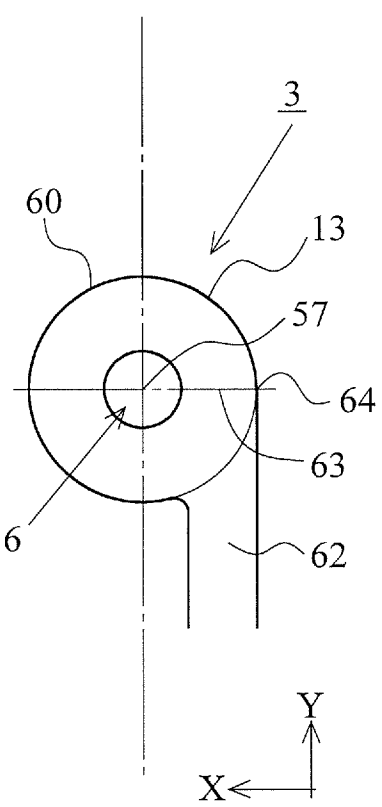
FIG. 9C is a right side view of FIG. 9B (corresponding to FIG. 3C).
Figure 9B:
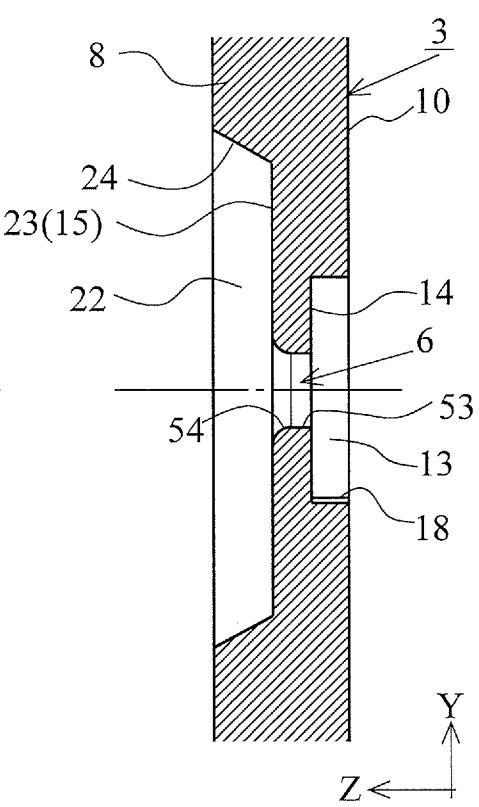
FIG. 9B is a cross-sectional view taken along a line A8-A8 in FIG. 9A (corresponding to FIG. 3B)
Figure 9A:
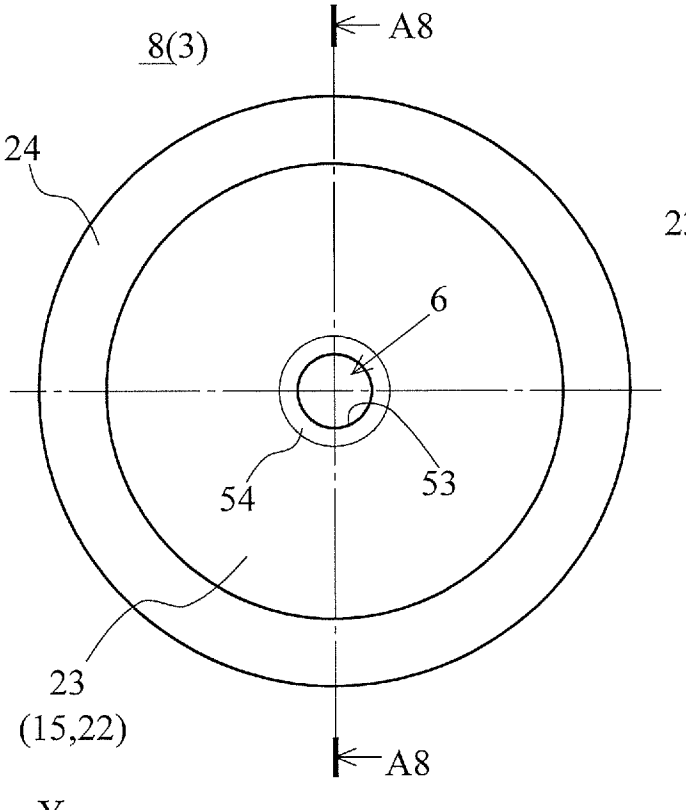
FIG. 9A is an enlarged view of a part of the nozzle plate (periphery of the nozzle holes) (corresponding to FIG. 3A)

FIG. 9 shows a nozzle plate 3 according to the present modification, and correspond to FIG. 3. FIG. 9A is an enlarged view of a part of the nozzle plate 3 (periphery of the nozzle holes 6) (corresponding to FIG. 3A), FIG. 9B is a cross-sectional view taken along a line A8-A8 in FIG. 9A (corresponding to FIG. 3B), and FIG. 9C is a right side view of FIG. 9B (corresponding to FIG. 3C).

At the nozzle plate 3 according to the present modification shown in FIG. 9, a configuration of the nozzle hole 6 is identical to that of the nozzle hole 6 of the nozzle plate 3 according to the first embodiment (the configuration of the nozzle hole 6 shown in FIGS. 3B, D), and configurations of the swirl chamber 13 and the fuel guide channel 62 are different from those of the nozzle plate 3 according to the first embodiment the configuration shown in FIG. 3C).

That is, in the nozzle plate according to the present modification, the swirl chamber 13 is formed in a circular shape which is concentric with the nozzle hole 6. Also, the fuel guide channel 62 is formed so as to extend in a Y-axis direction from an intersection point 64 where a center line 63 passing a center 57 of the swirl chamber 13 and in parallel with the X-axis intersects with an outer edge 60 of the swirl chamber 13. Further, the swirl chamber 13 and the fuel guide channel 62 are shaped in the same depth dimension.

In such a nozzle plate 3 according to the present modification, the fuel flowed from the fuel guide channels 62 into the swirl chamber 13 is guided to the nozzle hole 6 while swirling in the swirl chamber 13, the fuel flowing swirlingly in the round hole 53 of the nozzle hole 6 generates a flow along the curved surface 54 of the nozzle hole 6 by means of Coanda effect, thus expanding the fuel flow by the curved surface 54 to form a thin film-like flow. As a result, a nozzle plate 3 according to the present modification sufficiently spreads the spray generated by injection of fuel from a nozzle hole 6, ensures further minute fuel microparticles in spraying compared to conventional examples, and ensures the further homogeneous fuel microparticles in spraying compared to conventional examples.

Second Embodiment

FIG. 10 shows a nozzle plate 3 according to the second embodiment of the present invention, and correspond to FIG. 3. FIG. 10A is an enlarged view of a part of the nozzle plate 3 (periphery of the nozzle holes 6) (corresponding to FIG. 3A), FIG. 10B is a cross-sectional view taken along a line A9-A9 in FIG. 10A (corresponding to FIG. 3B), FIG. 10C is a partial enlarged view of FIG. 10B (corresponding to FIG. 3D), and FIG. 10D shows a modification of the nozzle holes 6 of the nozzle plate 3 according to the present embodiment (corresponding to FIG. 10C).

At the nozzle plate 3 according to the present embodiment shown in FIG. 10, configurations of the swirl chamber 13 and the first and second fuel guide channels 18 and 20 are similar to those shown in FIG. 3C. Also, a configuration of a portion near fuel-outflow end 52 of the nozzle hole 6 is similar to those shown in FIG. 3D. However, a configuration of the portion near fuel-inflow end 51 of the nozzle hole 6 in the nozzle plate 3 according to the present embodiment is different from that of the nozzle plate 3 according to the first embodiment.

Figure 10C:
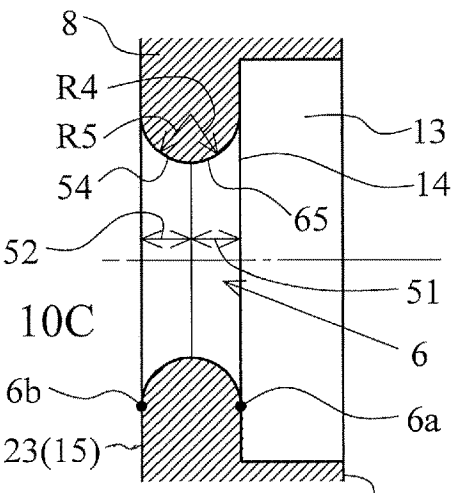
FIG. 10C is a partial enlarged view of FIG. 10B (corresponding to FIG. 3D)

That is, in the nozzle plate 3 according to the present embodiment, the portion near fuel-inflow end 51 of the nozzle hole 6 is a fuel guide curved surface 65 which gradually reduces the flow passage cross-sectional area from the fuel inflow-side opening end 6*a* to the portion near fuel-outflow end 52. In the fuel guide curved surface 65, as shown in FIGS. 10B-C, the upstream end in the fuel flow direction (the fuel inflow-side opening end 6*a* of the nozzle hole 6) is smoothly connected to the bottom surface 14 of the swirl chamber 13, and a tangential direction along a bus-bar direction of a fuel inflow-side opening end 6*a* corresponds to a direction along the bottom surface 14 of the swirl chamber 13 (direction along the Y-axis in FIG. 10B). Also, in the fuel guide curved surface 65, as shown in FIGS. 10B-C, the downstream end in the fuel flow direction is smoothly connected to the curved surface 54 formed in the portion near fuel-outflow end 52, and a tangential direction along a bus-bar direction at the downstream end corresponds to a tangential direction along the bus-bar direction of the upstream end of the curved surface 54. Then, as shown in FIGS. 10B-C, the fuel guide curved surface 65 is in an arc shape (arc of a quadrant of perfect circle) that is convex toward a center of the nozzle hole 6. Also, the curved surface 54 formed in the portion near fuel-outflow end 52 of the nozzle hole 6 is smoothly connected to the downstream end of the fuel guide curved surface 65, and is formed so as to gradually increase the flow passage cross-sectional area from the upstream end to the downstream end (the fuel outflow-side opening end 6*b* of the nozzle hole 6) in the fuel flow direction. Then, as shown in FIGS. 10B-C, the curved surface 54 is in an arc shape (arc of a quadrant of perfect circle) that is convex toward a center of the nozzle hole 6. With the nozzle hole 6, a spread level of spray can be changed by changing the radius of curvature R4 of the fuel guide curved surface 65 and the radius of curvature R5 of the curved surface 54.

In such a nozzle plate 3 according to the present embodiment, the fuel swirled in the swirl chamber 13 is smoothly guided to the nozzle hole 6 and, the fuel flowing swirlingly along the fuel guide curved surface 65 generates a flow along the curved surface 54 of the nozzle hole 6 by means of Coanda effect, thus expanding the fuel flow by the curved surface 54 to form a thin film-like flow. As a result, a nozzle plate 3 according to the present embodiment sufficiently spreads the spray generated by injection of fuel from a nozzle hole 6, ensures further minute fuel microparticles in spraying compared to conventional examples, and ensures the further homogeneous fuel microparticles in spraying compared to conventional examples. In the fuel guide curved surface 65 of the nozzle plate 3 according to the present embodiment, a tangential direction along the bus-bar direction in the fuel outflow-side opening end 6*a* may be formed to intersect in an oblique direction with the bottom surface 14 of the swirl chamber 13.

Modification of Second Embodiment

Figure 10D:
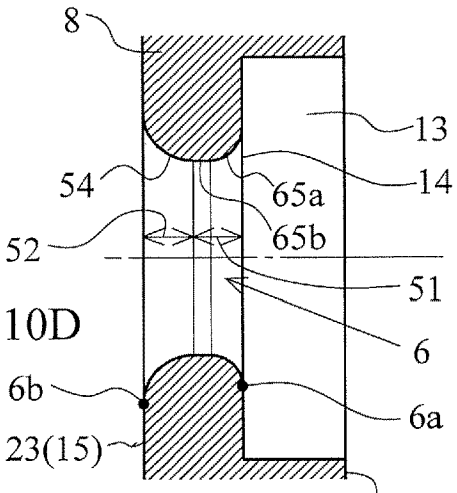
FIG. 10D shows a modification of the nozzle holes 6 of the nozzle plate 3 according to the present embodiment (corresponding to FIG. 10C).
Figure 10B:
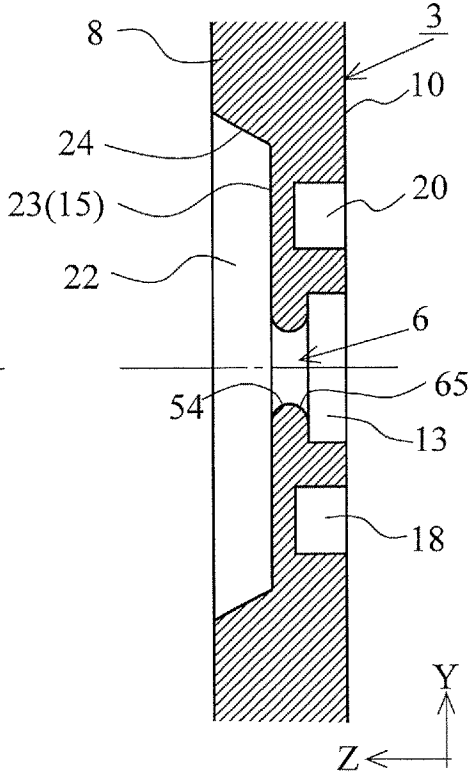
FIG. 10B is a cross-sectional view taken along a line A9-A9 in FIG. 10A (corresponding to FIG. 3B)
Figure 10A:
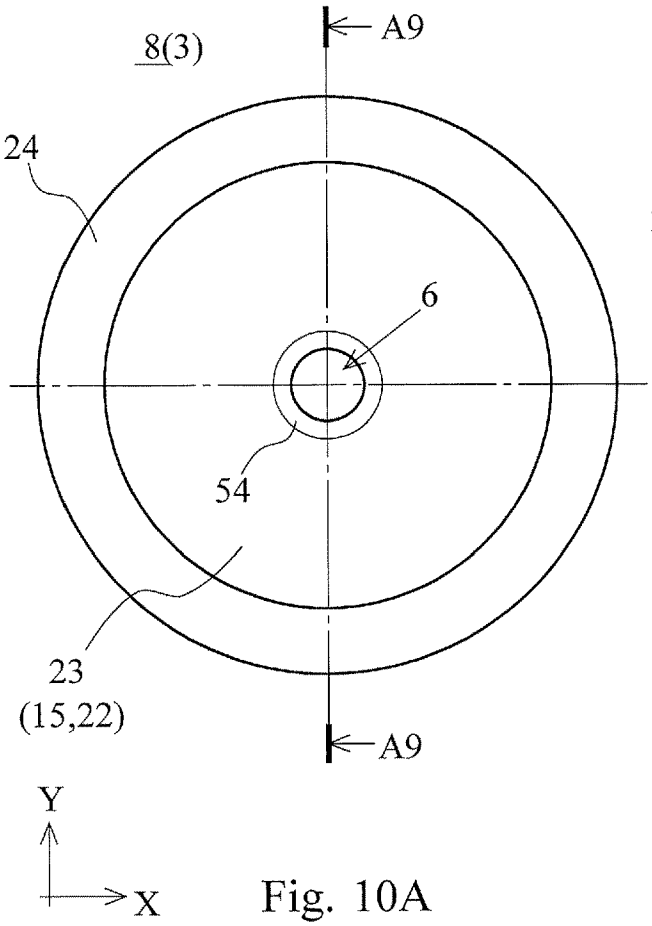
FIG. 10A is an enlarged view of a part of the nozzle plate 3 (periphery of the nozzle holes 6) (corresponding to FIG. 3A)

As shown in FIG. 10D, a configuration of the portion near fuel-inflow end 51 of the nozzle hole 6 in the nozzle plate 3 according to the present modification is different from that of the nozzle plate 3 according to the second embodiment. That is, in the nozzle plate 3 according to the present modification, the portion near fuel-inflow end 51 of the nozzle hole 6 includes a fuel guide curved surface 65*a* which gradually reduces the flow passage cross-sectional area from the fuel inflow-side opening end 6*a* toward the portion near fuel-outflow end 52, and an inner circumferential surface 65*b* of a round-hole-like portion smoothly connected to a downstream end of the fuel guide curved surface 65*a* in the fuel flow direction and extending up to the curved surface 54 formed in a portion near fuel-outflow end 52 of the nozzle hole 6 without changing the flow passage cross-sectional area. The inner circumferential surface 65*b* has an upstream end in fuel flow direction that is smoothly connected to the fuel guide curved surface 65*a*, and a downstream end in fuel flow direction that is smoothly connected to the curved surface 54.

Such a nozzle plate 3 according to the present modification can obtain an effect similar to that of the nozzle plate 3 according to the second embodiment. That is, in such a nozzle plate 3 according to the present modification, the fuel swirled in the swirl chamber 13 is smoothly guided to the nozzle hole 6 and, the fuel flowing swirlingly along the fuel guide curved surface 65*a* and the inner circumferential surface 65*b* generates a flow along the curved surface 54 of the nozzle hole 6 by means of Coanda effect, thus expanding the fuel flow by the curved surface 54 to form a thin film-like flow. As a result, a nozzle plate 3 according to the present modification sufficiently spreads the spray generated by injection of fuel from a nozzle hole 6, ensures further minute fuel microparticles in spraying compared to conventional examples, and ensures the further homogeneous fuel microparticles in spraying compared to conventional examples.

Third Embodiment

Figure 11C:
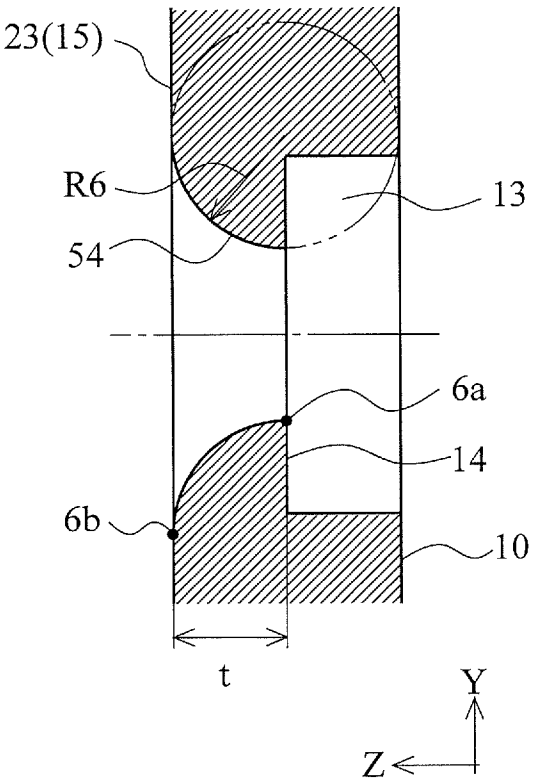
FIG. 11C is a partial enlarged view of FIG. 11B (corresponding to FIG. 3D).
Figure 11B:
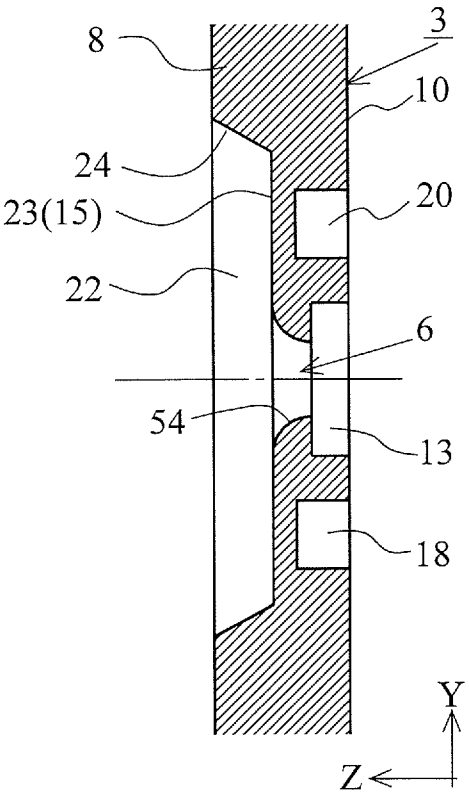
FIG. 11B is a cross-sectional view taken along a line A10-A10 in FIG. 11A (corresponding to FIG. 3B)
Figure 11A:
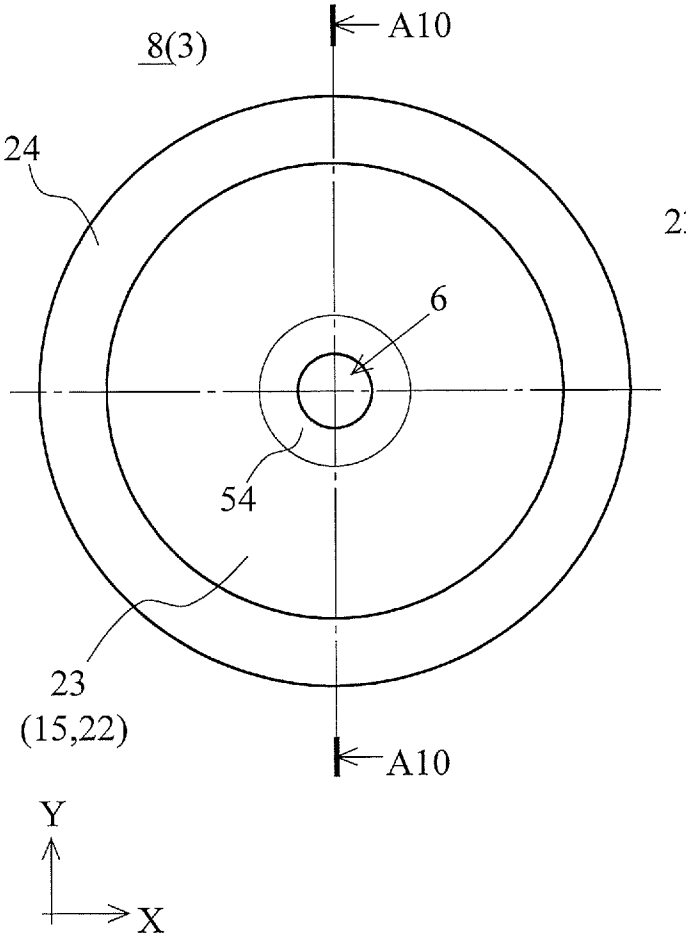
FIG. 11A is an enlarged view of a part of the nozzle plate (periphery of the nozzle holes) (corresponding to FIG. 3A)

FIG. 11 shows a nozzle plate 3 according to the third embodiment of the present invention, and correspond to FIG. 3. FIG. 11A is an enlarged view of a part of the nozzle plate 3 (periphery of the nozzle holes 6) (corresponding to FIG. 3A), FIG. 11B is a cross-sectional view taken along a line A10-A10 in FIG. 11A (corresponding to FIG. 3B), and FIG. 11C is a partial enlarged view of FIG. 11B (corresponding to FIG. 3D).

At the nozzle plate 3 according to the present embodiment shown in FIG. 11, configurations of the swirl chamber 13 and the first and second fuel guide channels 18 and 20 are similar to those shown in FIG. 3C. However, a configuration of the nozzle hole 6 in the nozzle plate 3 according to the present embodiment is different from that of the nozzle plate 3 according to the first embodiment.

That is, in the nozzle plate 3 according to the present embodiment, the nozzle hole 6 is a curved surface 54 which gradually increases the flow passage cross-sectional area from the fuel inflow-side opening end 6*a* to the fuel outflow-side opening end 6*b*. As shown in FIGS. 11B-C, the curved surface 54 is convex toward the center of the nozzle hole 6, where the fuel inflow-side opening end 6*a* opens so as to be perpendicular to the bottom surface 14 of the swirl chamber 13, and the fuel outflow-side opening end 6*b* opens so as to be in contact with the outer surface 15 of the plate body portion 8 (the bottom surface 23 of the recess 22). Radius of curvature R6 of the curved surface 54 has the same dimension as a thickness dimension t between the bottom surface 14 of the swirl chamber 13 and the bottom surface 23 of the recess 22.

In a nozzle plate 3 configured as such according to the present invention, the fuel guided into the nozzle hole 6 while swirling in the swirl chamber 13 in the identical direction generates a flow along the curved surface 54 by means of Coanda effect, thus expanding the fuel flow by the curved surface 54 to form a thin film-like flow. As a result, a nozzle plate 3 according to the present embodiment sufficiently spreads the spray generated by injection of fuel from a nozzle hole 6, ensures further minute fuel microparticles in spraying compared to conventional examples, and ensures the further homogeneous fuel microparticles in spraying compared to conventional examples.

Fourth Embodiment

Figure 12C:
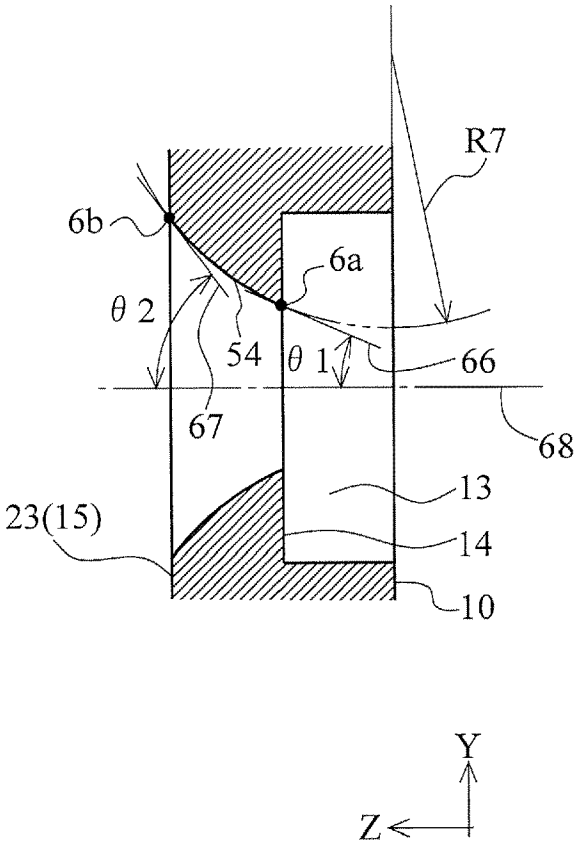
FIG. 12C is a partial enlarged view of FIG. 12B (corresponding to FIG. 11C).
Figure 12B:
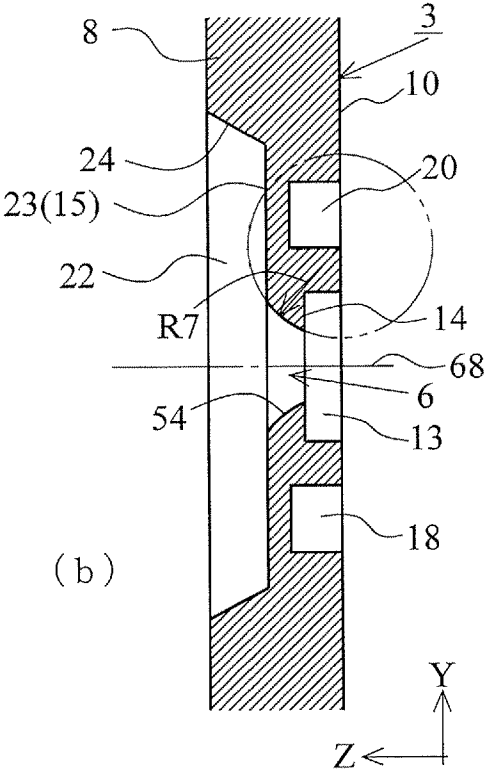
FIG. 12B is a cross-sectional view taken along a line A11-A11 in FIG. 12A (corresponding to FIG. 11B)
Figure 12A:
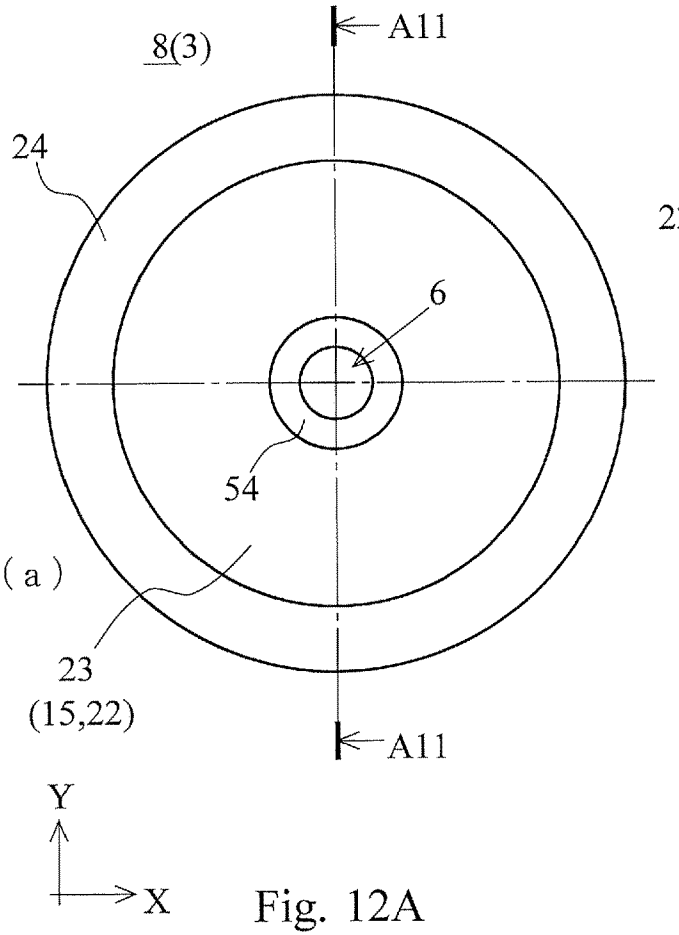
FIG. 12A is an enlarged view of a part of the nozzle plate (periphery of the nozzle holes) (corresponding to FIG. 11A)

FIG. 12 is a view of a nozzle plate 3 according to a fourth embodiment of the present invention, and a view showing a modification of the nozzle plate 3 according to the third embodiment. FIG. 12A is an enlarged view of a part of the nozzle plate 3 (periphery of the nozzle holes 6) (corresponding to FIG. 11A), FIG. 12B is a cross-sectional view taken along a line A11-A11 in FIG. 12A (corresponding to FIG. 11B), and FIG. 12C is a partial enlarged view of FIG. 12B (corresponding to FIG. 11C).

While a configuration of the curved surface 54 of the nozzle hole 6 in the nozzle plate 3 according to the present embodiment shown in FIG. 12 is different from that of the nozzle plate 3 according to the third embodiment, other configurations are identical to those of the nozzle plate 3 according to the third embodiment. Therefore, in the nozzle plate 3 of the present embodiment, the same reference characters as those in the nozzle plate 3 according to the third embodiment are used to represent the same component, and redundant description of already described nozzle plate 3 according to the third embodiment is omitted.

In the nozzle plate 3 according to the present embodiment, the nozzle hole 6 is a curved surface 54 which gradually increases the flow passage cross-sectional area from the fuel inflow-side opening end 6*a* to the fuel outflow-side opening end 6*b*, and which is convex toward the center of the nozzle hole 6. Then, in the curved surface 54, a tangential line 66 along a bus-bar direction at the fuel inflow-side opening end 6*a* intersects in an oblique direction with the bottom surface 14 of the swirl chamber 13, and a tangential line 67 along a bus-bar direction at the fuel outflow-end-side opening end 6*b* intersects in an oblique direction with the outer surface 15 (the bottom surface 23 of the recess 22) of the plate body portion 8. Radius of curvature R7 of the curved surface 54 is larger than the radius of curvature R6 of the curved surface 54 of the nozzle plate 3 according to the third embodiment.

In a nozzle plate 3 configured as such according to the present invention, the fuel guided into the nozzle hole 6 while swirling in the swirl chamber 13 in the identical direction generates a flow along the curved surface 54 by means of Coanda effect, thus expanding the fuel flow by the curved surface 54 to form a thin film-like flow. As a result, a nozzle plate 3 according to the present embodiment sufficiently spreads the spray generated by injection of fuel from a nozzle hole 6, ensures further minute fuel microparticles in spraying compared to conventional examples, and ensures the further homogeneous fuel microparticles in spraying compared to conventional examples.

Also, in the nozzle plate 3 according to the present embodiment in FIG. 12C, a spread level of spray can be changed by changing the angle (θ1) between the tangential line 66 of the fuel inflow-side opening end 6*a* of the curved surface 54 and a center axis 68 of the nozzle hole 6, the angle (θ2) between the tangential line 67 of the fuel outflow-side opening end 6*b* of the curved surface 54 and the center axis 68 of the nozzle hole 6, and the radius of curvature R7 of the curved surface 54.

Fifth Embodiment

FIG. 13 shows a nozzle plate 3 according to the fifth embodiment of the present invention. FIG. 13A is an enlarged view of a part of the nozzle plate 3 (periphery of the nozzle holes 6) (corresponding to FIG. 3A), FIG. 13B is a cross-sectional view taken along a line A12-A12 in FIG. 13A (corresponding to FIG. 3B), FIG. 13C is a cross-sectional view taken along a line A13-A13 in FIG. 13A, FIG. 13D is a partial enlarged view of FIG. 13B (corresponding to FIG. 3D), and FIG. 13E is a partial enlarged view of FIG. 13C.

The swirl chamber 13 and the first and second fuel guide channels 18, 20 of the nozzle plate 3 according to the present embodiment are identical to those of the nozzle plate 3 according to the first embodiment, as shown in FIG. 3. Therefore, the same reference characters as those in the nozzle plate 3 according to the first embodiment are used to represent the same component, and redundant description of already described in the first embodiment is omitted.

As shown in FIG. 13, in the nozzle plate 3, the fuel outflow-side opening end 6*b* of the nozzle hole 6 is formed of one end of the curved surface 54 forming an inner surface of the nozzle hole 6, and a region from the fuel inflow-side opening end 6*a* of the nozzle hole 6 to the curved surface 54 is formed in a round hole 53 having the same flow passage cross-sectional area. Then, the curved surface 54 of the nozzle hole 6 is formed so as to gradually increase a flow passage cross-sectional area toward a downstream side in fuel flow direction, and is formed so as to be convex toward a center of the nozzle hole 6. Also, when an imaginary plane that is perpendicular to a center axis 68 of the nozzle hole 6 is an X-Y coordinate plane and the fuel outflow-side opening end 6*b* is projected onto the X-Y coordinate plane, and when the center line passing a center of the nozzle hole 6 on the X-Y coordinate plane and in parallel with the X-axis is a first center line 70 and the center line passing the center of the nozzle hole 6 on the X-Y coordinate plane and in parallel with the Y-axis is a second center line 71, the curved surface 54 of the nozzle hole 6 is configured to have a radius of curvature gradually increasing (R8<R9) from intersection points 72*a*, 72*b* between the fuel outflow-side opening end 6*b* and the first center line 70 toward intersection points 73*a*, 73*b* between the fuel outflow-side opening end 6*b* and the second center line 71. As a result, the fuel outflow-side opening end 6*b* projected on the X-Y coordinate plane is in a linear-symmetric shape with respect to a first center line 70, Then, the other end of the curved surface 54 is smoothly connected to the other inner surface (inner surface of the round hole 53) of the nozzle hole 6 adjacent to the curved surface 54.

In a nozzle plate 3 configured as such according to the present embodiment, the fuel flowing swirlingly from the swirl chamber 13 into the round hole 53 of the nozzle hole 6 generates a flow along the curved surface 54 by means of Coanda effect, thus expanding the fuel flow by the curved surface 54 to form a thin film-like flow. As a result, a nozzle plate 3 according to the present embodiment sufficiently spreads the spray generated by injection of fuel from a nozzle hole 6, ensures further minute fuel microparticles in spraying compared to conventional examples, and ensures the further homogeneous fuel microparticles in spraying compared to conventional examples.

Also, in the nozzle plate 3 according to the present embodiment, radius of curvature of the curved surface 54 is configured to gradually increase from the intersection points 72*a*, 72*b* between the fuel outflow-side opening end 6*b* and the first center line 70 toward the intersection points 73*a*, 73*b* between the fuel outflow-side opening end 6*b* and the second center line 71 (gradually increase from radius of curvature R8 to radius of curvature R9), and is configured such that a spread level of the fuel flow is large at a region of large radius of curvature (a region of radius of curvature R9) in the curved surface 54 and a spread level of the fuel flow is small at a region of small radius of curvature (a region of radius of curvature R8) in the curved surface 54. As a result, in the nozzle plate 3 according to the present embodiment, a spray of the fuel injected from the nozzle hole 6 is largely expanded in two directions along the Y-axis, and a spray of the fuel injected from the nozzle hole 6 is narrowly expanded in two directions along the X-axis.

Modification of Fifth Embodiment

FIG. 14 shows a nozzle plate 3 according to a modification of the fifth embodiment of the present invention. FIG. 14A is an enlarged view of a part of the nozzle plate 3 (periphery of the nozzle holes 6) (corresponding to FIG. 13A), FIG. 14B is a cross-sectional view taken along a line A14-A14 in FIG. 14A (corresponding to FIG. 3B), FIG. 14C is a cross-sectional view taken along a line A15-A15 in FIG.

14A, FIG. 14D is a partial enlarged view of FIG. 14B (corresponding to FIG. 13D), and FIG. 14E is a partial enlarged view of FIG. 14C.

A configuration of the nozzle hole 6 in the nozzle plate 3 according to the present modification shown in FIG. 14 is different from that of the nozzle plate 3 according to the fifth embodiment. It is to be noted that, in the nozzle plate 3 of the present modification as shown in FIG. 14, the same reference characters as those in the nozzle plate 3 according to the fifth embodiment are used to represent the same component, and redundant description of already described in the fifth embodiment is omitted.

As shown in FIG. 14, in the nozzle plate 3, the fuel outflow-side opening end 6*b* of the nozzle hole 6 is formed of one end of the curved surface 54 forming an inner surface of the nozzle hole 6, and a region from the fuel inflow-side opening end 6*a* of the nozzle hole 6 to the curved surface 54 is formed in a round hole 53 having the same flow passage cross-sectional area. Then, the curved surface 54 of the nozzle hole 6 is smoothly connected to the downstream side end of the round hole 53 in fuel flow direction (end along Z-axis direction) on the same circumference, is formed so as to gradually increase a flow passage cross-sectional area toward a downstream side in fuel flow direction, and is formed so as to be convex toward a center of the nozzle hole 6. Also, when an imaginary plane that is perpendicular to a center axis 68 of the nozzle hole 6 is an X-Y coordinate plane and the fuel outflow-side opening end 6*b* is projected onto the X-Y coordinate plane, and when the center line passing a center of the nozzle hole 6 on the X-Y coordinate plane and in parallel with the X-axis is a first center line 70 and the center line passing the center of the nozzle hole 6 on the X-Y coordinate plane and in parallel with the Y-axis is a second center line 71, the curved surface 54 of the nozzle hole 6 is configured to have a radius of curvature gradually increasing (R10<R11) from intersection points 73*a*, 73*b* between the fuel outflow-side opening end 6*b* and the second center line 71 toward intersection points 72*a*, 72*b* between the fuel outflow-side opening end 6*b* and the first center line 70. As a result, the fuel outflow-side opening end 6*b* projected on the X-Y coordinate plane is in a linear-symmetric shape with respect to a first center line 70, Then, the other end of the curved surface 54 is smoothly connected to the other inner surface (inner surface of the round hole 53) of the nozzle hole 6 adjacent to the curved surface 54. As shown in FIG. 14D, the curved surface 54 is smoothly connected to the outer surface 12 of the nozzle plate 3 (the bottom surface 23 of the recess 22) at a position on the second center line 71 of the fuel outflow-side opening end 6*b* (tangential line along the bus-bar direction corresponds to the outer surface 15 (the bottom surface 23) of the nozzle plate 3.

In a nozzle plate 3 configured as such according to the present modification, in the same manner as the nozzle plate 3 according to the fifth embodiment, the fuel flowing swirlingly from the swirl chamber 13 into the round hole 53 of the nozzle hole 6 generates a flow along the curved surface 54 by means of Coanda effect, thus expanding the fuel flow by the curved surface 54 to form a thin film-like flow. As a result, a nozzle plate 3 according to the present modification sufficiently spreads the spray generated by injection of fuel from a nozzle hole 6, ensures further minute fuel microparticles in spraying compared to conventional examples, and ensures the further homogeneous fuel microparticles in spraying compared to conventional examples.

Also, in the nozzle plate 3 according to the present modification, radius of curvature of the curved surface 54 is configured to gradually increase from the intersection points 73*a*, 73*b* between the fuel outflow-side opening end 6*b* and the second center line 71 toward the intersection points 72*a*, 72*b* between the fuel outflow-side opening end 6*b* and the first center line 70 (gradually increase from radius of curvature R10 to radius of curvature R11), and is configured such that a spread level of the fuel flow is large at a region of small radius of curvature (a region of radius of curvature R10) in the curved surface 54 and a spread level of the fuel flow is small at a region of large radius of curvature (a region of radius of curvature R11) in the curved surface 54. As a result, in the nozzle plate 3 according to the present embodiment, a spray of the fuel injected from the nozzle hole 6 is largely expanded in two directions along the Y-axis, and a spray of the fuel injected from the nozzle hole 6 is narrowly expanded in two directions along the X-axis.

Sixth Embodiment

Figures 15A, 15B, 15C, 15D, 15E, 15F:
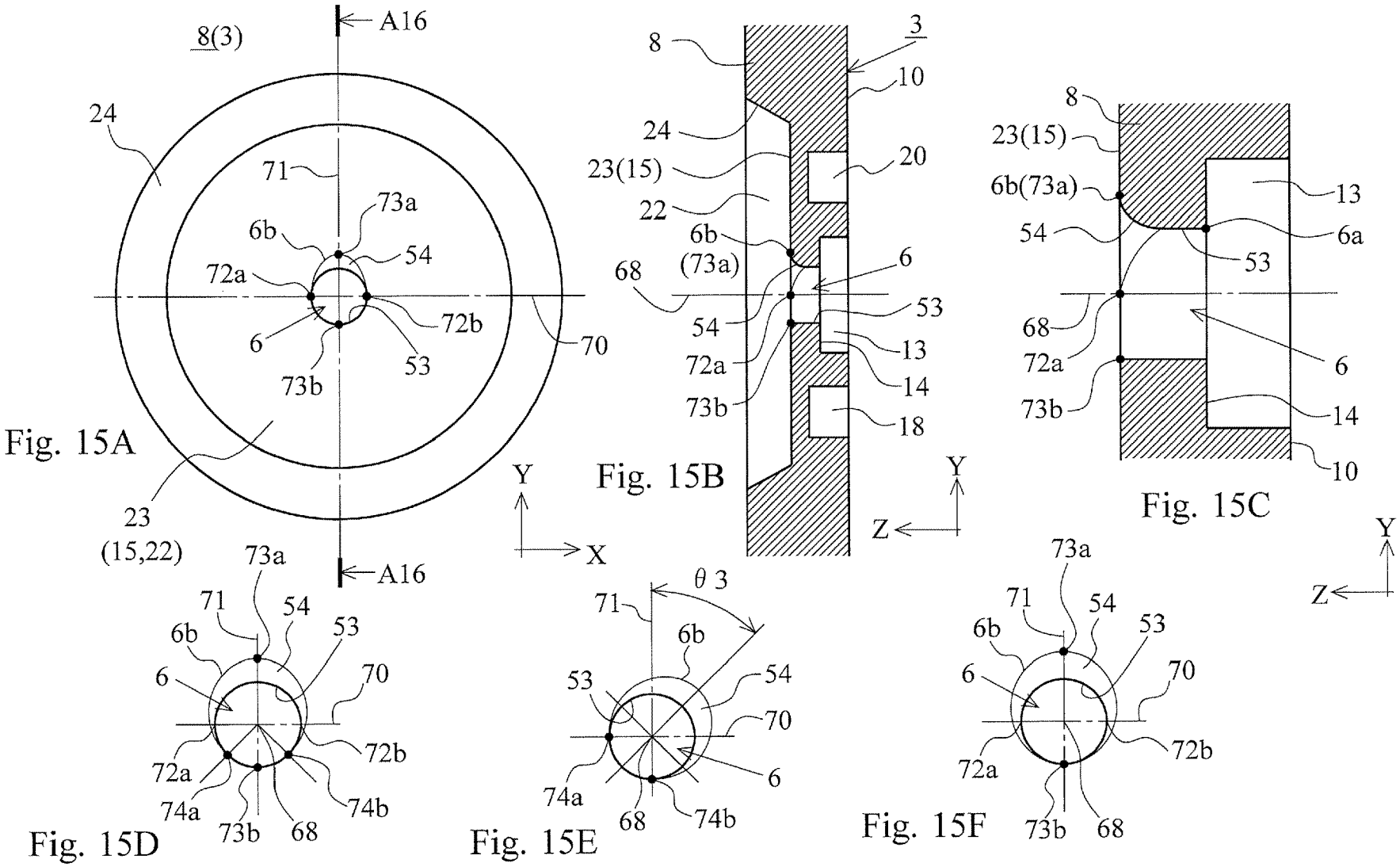
FIG. 15A is an enlarged view of a part of the nozzle plate (periphery of the nozzle holes) (corresponding to FIG. 13A)
FIG. 15B is a cross-sectional view taken along a line A16-A16 in FIG. 15A (corresponding to FIG. 13B)
FIG. 15C is a partial enlarged view of FIG. 15B (corresponding to FIG. 13D)
FIG. 15D shows a modification 1 of the present embodiment (plan view of a fuel outflow-side opening end of the nozzle holes)
FIG. 15E shows a modification 2 of the present embodiment (plan view of a fuel outflow-side opening end of the nozzle holes)
FIG. 15F shows a modification 3 of the present embodiment (plan view of a fuel outflow-side opening end of the nozzle holes).
Figure 16A:
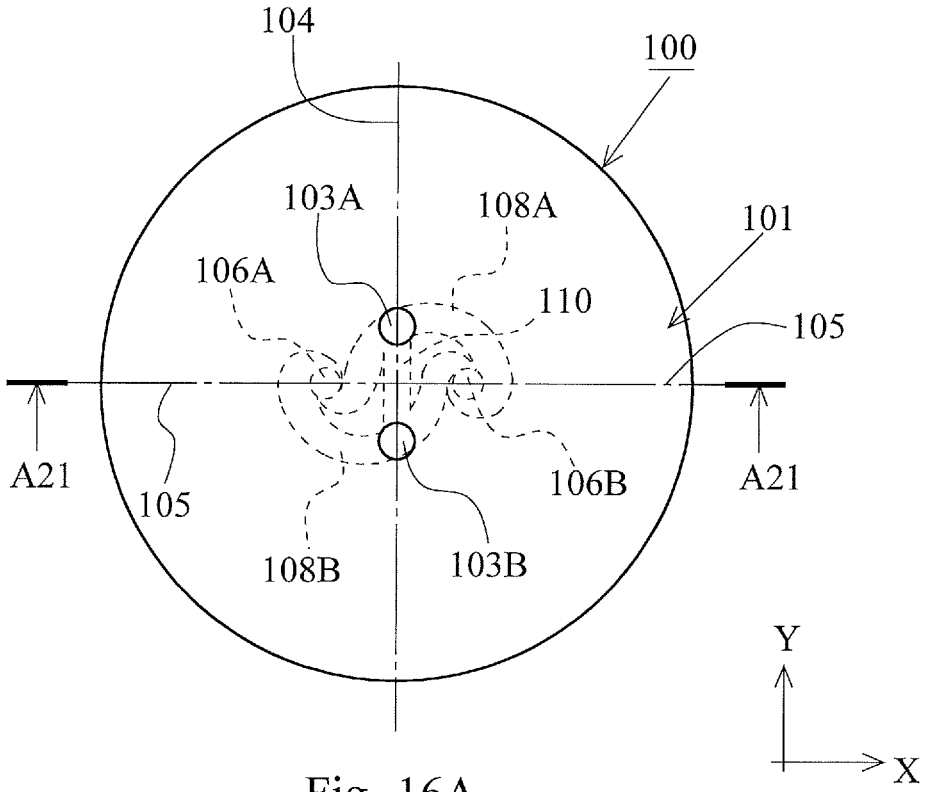
Fig. 16A (Related Art)
FIG. 16A is a front view of the nozzle plate.
Figure 16B:
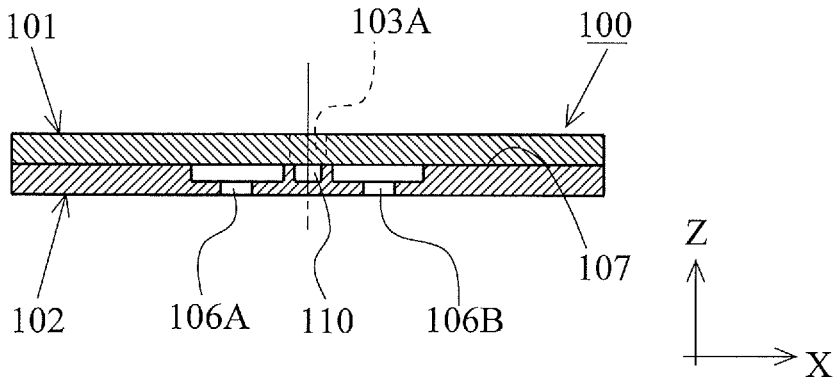
Fig.16B (Related Art)
FIG. 16B is a cross-sectional view of the nozzle plate taken along a line A21-A21 in FIG. 16A.
Figure 17A:
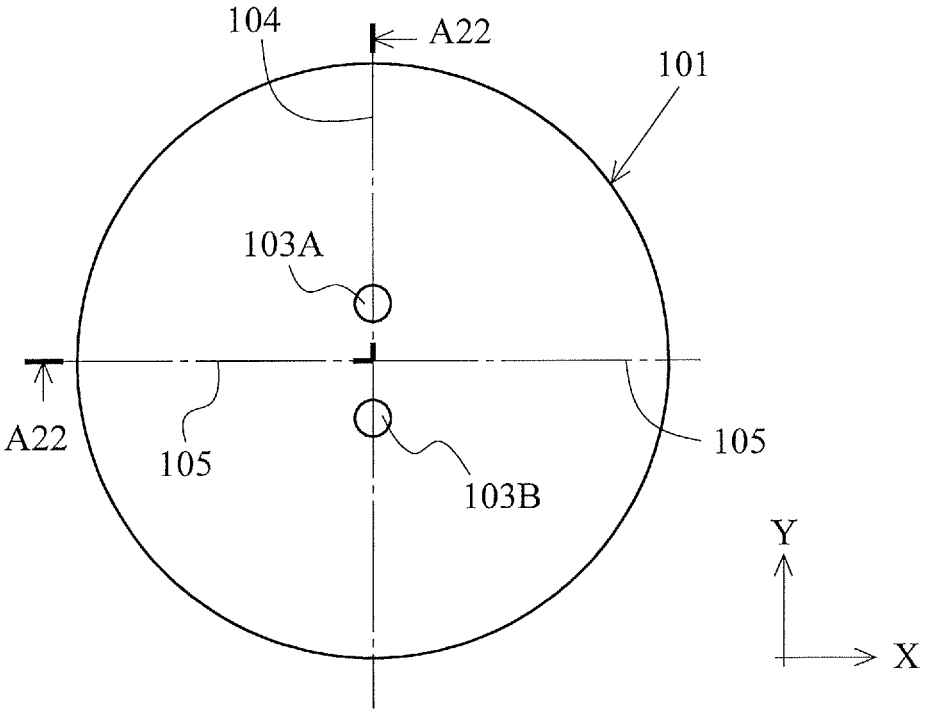
Fig. 17A (Related Art)
FIG. 17A is a front view of the first nozzle plate.
Figure 17B:
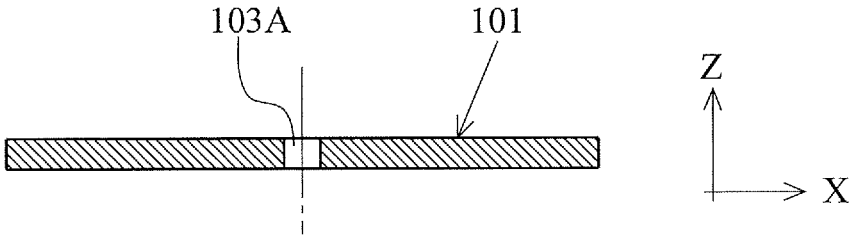
Fig.17B (Related Art)
FIG. 17B is a cross-sectional view of the first nozzle plate taken along a line A22-A22 in FIG. 17A.
Figure 18A:
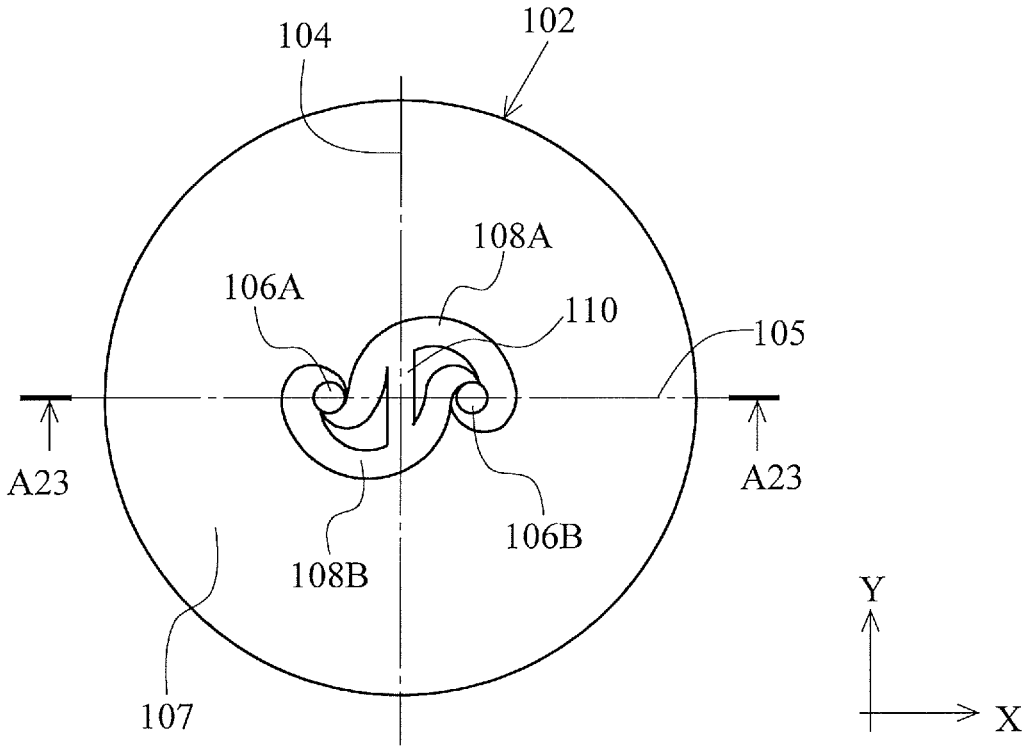
Fig. 18A (Related Art)
FIG. 18A is a front view of the second nozzle plate.
Figure 18B:
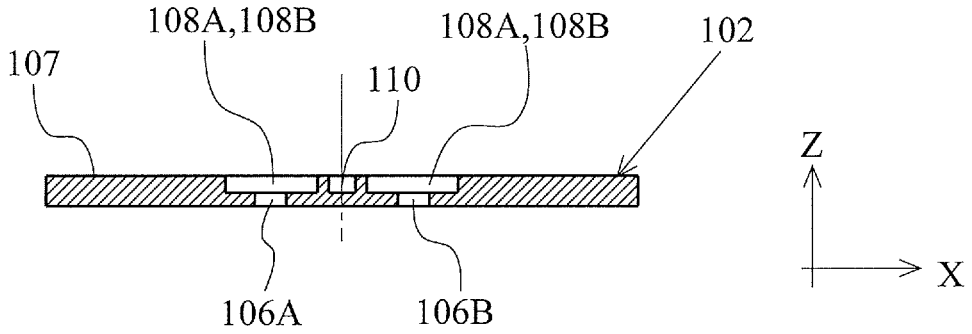
Fig.18B (Related Art)
FIG. 18B is a cross-sectional view of the second nozzle plate taken along a line A23-A23 in FIG. 18A.

FIG. 15 is a view of a nozzle plate 3 according to a sixth embodiment of the present invention, and a view showing a modification of the nozzle plate 3 according to the fifth embodiment. FIG. 15A is an enlarged view of a part of the nozzle plate 3 (periphery of the nozzle holes 6) (corresponding to FIG. 13A), FIG. 15B is a cross-sectional view taken along a line A16-A16 in FIG. 15A (corresponding to FIG. 13B), and FIG. 15C is a partial enlarged view of FIG. 15B (corresponding to FIG. 13D).

While the curved surface 54 of the nozzle hole 6 of the nozzle plate 3 according to the present embodiment shown in FIG. 15 is different from that of the nozzle plate 3 according to the fifth embodiment, other components are identical to those of the nozzle plate 3 according to the first embodiment. Therefore, the same reference characters as those in the nozzle plate 3 according to the fifth embodiment are used to represent the same component, and redundant description of already described in the fifth embodiment is omitted.

As shown in FIG. 15, in the nozzle plate 3, a part of the fuel outflow-side opening end 6*b* of the nozzle hole 6 is formed of one end of the curved surface 54 forming a part of an inner surface of the nozzle hole 6, and other region than the curved surface 54 of the nozzle hole 6 is formed in a round hole 53. The curved surface 54 is formed so as to gradually increase a flow passage cross-sectional area toward a downstream side in fuel flow direction, and is formed so as to be convex toward a center of the nozzle hole 6. Also, when an imaginary plane that is perpendicular to a center axis 68 is an X-Y coordinate plane and the fuel outflow-side opening end 6*b* is projected onto the X-Y coordinate plane, and when the center line passing a center of the nozzle hole 6 on the X-Y coordinate plane and in parallel with the X-axis is a first center line 70 and the center line passing the center of the nozzle hole 6 on the X-Y coordinate plane and in parallel with the Y-axis is a second center line 71, the curved surface 54 of the nozzle hole 6 is configured to have a radius of curvature gradually increasing from two intersection points 72*a*, 72*b* between the fuel outflow-side opening end 6*b* and the first center line 70 toward one of two intersection points 73*a*, 73*b* (intersection point 73*a*) between the fuel outflow-side opening end 6*b* and the second center line 71. Then, the other end of the curved surface 54 is smoothly connected to the other inner surface (inner surface of the round hole 53) of the nozzle hole 6 adjacent to the curved surface 54.

In a nozzle plate 3 configured as such according to the present embodiment, the fuel flowing swirlingly from the swirl chamber 13 into the round hole 53 of the nozzle hole 6 generates a flow along the curved surface 54 by means of Coanda effect, thus expanding the fuel flow by the curved surface 54 to form a thin film-like flow. As a result, a nozzle plate 3 according to the present embodiment spreads the spray generated by injection of fuel from a nozzle hole 6 in one direction, ensures further minute fuel microparticles in spraying compared to conventional examples, and ensures the further homogeneous fuel microparticles in spraying compared to conventional examples.

Modification 1 of Sixth Embodiment

In the nozzle plate 3 according to the present embodiment, the curved surface 54 starts from two intersection points 72*a*, 72*b* where the fuel outflow-side opening end 6*b* and the first center line 70 intersect (see FIG. 15A). However, the starting points 74*a*, 74*b* of the curved surface 54 may be shifted to another position on the fuel outflow-side opening end 6*b* (for example, a position near the intersection 73*b* where the fuel outflow-side opening end 6*b* and the second center line 71 intersect) (see FIG. 15D).

Modification 2 of Sixth Embodiment

Also, as shown in FIG. 15E, in the nozzle plate 3 according to the present embodiment, the curved surface 54 shown in FIG. 15D may be rotated about the center axis 68 of the nozzle hole 6 at a predetermined angle (for example, the curved surface 54 may be rotated about the center axis 68 of the nozzle hole 6 at an angle θ3 in a clockwise direction).

Modification 3 of Sixth Embodiment

Also, in the nozzle plate 3 according to the present embodiment, as shown in FIG. 15F, the curved surface 54 may start from one point on the fuel outflow-side opening end 6*b* (for example, the intersection point 73*b* where the fuel outflow-side opening end 6*b* and the second center line 71 intersect) and a radius of curvature of the curved surface 54 mat gradually increase toward another point on the fuel outflow-side opening end 6*b* (for example, the intersection point 73*a* where the fuel outflow-side opening end 6*b* and the second center line 71 intersect).

Other Embodiment

The nozzle plate 3 according to the first embodiment is configured to gradually reduce the channel widths of the first and second in-swirl-chamber fuel guide channel portions 47 and 48 toward the distal ends to gradually reduce the channel cross-sectional areas, but not limited to this. The nozzle plate 3 according to each above-described embodiment may be configured to gradually reduce the channel widths of the first and second in-swirl-chamber fuel guide channel portions 47 and 48 toward the distal ends to gradually reduce the channel cross-sectional areas.

Also, the nozzle plate 3 according to each above-described embodiment has exemplified an aspect where the nozzle holes 6 are formed at four positions at regular intervals around the center of the plate body portion 8, but not limited to this. The nozzle holes 6 may be formed at a plurality of positions equal to or more than two positions at regular intervals around the center of the plate body portion 8.

Further, the nozzle plate 3 according to each of the above-described embodiments may form a plurality of nozzle holes 6 at irregular intervals around the center of the plate body portion 8.

Further, the nozzle plate 3 according to each of the above-described embodiments is mainly formed by the injection molding, but not limited to this. The nozzle plate 3 may be formed such that a cutting work or the like is performed to a metal, and may be formed by using a metal injection molding method.

DESCRIPTION OF REFERENCE SIGNS

1: Fuel injection device
3: Nozzle plate (nozzle plate for fuel injection device)
5: Fuel injection port
6: Nozzle hole
8: Plate body portion
10: Inner surface
13: Swirl chamber
18, 20, 62: Fuel guide channel
51: Portion near fuel-inflow end
52: Portion near fuel-outflow end
54: Curved surface

The invention claimed is:

1. A nozzle plate of a fuel injection device to be arranged opposed to a fuel injection port of the fuel injection device, the nozzle plate comprising:

nozzle holes configured to allow fuel injected from the fuel injection port pass therethrough, the nozzle holes being coupled to the fuel injection port via a swirl chamber and fuel guide channels that open into the swirl chamber, the fuel guide channels including a first fuel guide channel and a second fuel guide channel, each of the nozzle holes being divided into an inlet portion near a fuel-inflow end and an outlet portion near a fuel-outflow end;

wherein the nozzle holes, the swirl chamber, and the fuel guide channels are formed on a plate body portion arranged to be opposed to the fuel injection port;

wherein the swirl chamber is configured to guide the fuel flowing from the fuel guide channels into the nozzle holes such that the first fuel guide channel and the second fuel guide channel swirl the fuel in the same swirl direction, and the swirl chamber is formed at a side of an inner surface to oppose the fuel injection port of the plate body portion;

wherein the outlet portion near fuel-outflow end of each of the nozzle holes is formed so as to have a flow passage cross-sectional area gradually increasing towards a fuel outflow-side opening end, and includes a curved surface formed by smoothly connecting an inner surface of the nozzle holes at an upstream end in a fuel flow direction to an inner surface of the nozzle holes at the inlet portion near the fuel-inflow end so as to smoothly and gradually increase the flow passage cross-sectional area; and wherein the curved surface is configured to ensure further thin film-like flow by expanding a flow of the fuel in the nozzle holes by Coanda effect.

2. The nozzle plate for a fuel injection device according to claim 1, wherein:

each of the nozzle holes includes a fuel inflow-side opening end positioned on a bottom surface of the swirl chamber, and the fuel outflow-side opening end of each of the nozzle holes is positioned on an outer surface of the plate body portion; and the inlet portion near the fuel-inflow end of each of the nozzle holes is configured to have the same flow passage cross-sectional area from the fuel inflow-side opening end to the fuel outflow-side opening end.

3. The nozzle plate for a fuel injection device according to claim 2, wherein the curved surface has the fuel outflow-side opening end smoothly connected to the outer surface of the plate body portion.

4. The nozzle plate for a fuel injection device according to claim 1, wherein:

each of the nozzle holes includes the fuel inflow-side opening end positioned on the bottom surface of the swirl chamber, and the fuel outflow-side opening end positioned on the outer surface of the plate body portion;

the portion near the fuel-inflow end of each of the nozzle holes is a fuel guide curved surface that gradually reduces the flow passage cross-sectional area from the fuel inflow-side opening end to the fuel outflow-side opening end; and the curved surface formed at the portion near the fuel-outflow end of each of the nozzle holes is smoothly connected to the fuel guide curved surface.

5. The nozzle plate for a fuel injection device according to claim 1, wherein each of the nozzle holes includes the fuel inflow-side opening end positioned on the bottom surface of the swirl chamber, and the fuel outflow-side opening end positioned on the outer surface of the plate body portion;

the portion near the fuel-inflow end of each of the nozzle holes includes a fuel guide curved surface which gradually reduces the flow passage cross-sectional area from the fuel inflow-side opening end toward the portion near the fuel-outflow end, and an inner circumferential surface smoothly connected to the fuel guide curved surface and extending up to the curved surface formed in the portion near the fuel-outflow end of the nozzle hole without changing the flow passage cross-sectional area.

6. The nozzle plate for a fuel injection device according to claim 4, wherein:

the fuel guide curved surface has the fuel inflow-side opening end smoothly connected to the bottom surface of the swirl chamber; and the curved surface has the fuel outflow-side opening end smoothly connected to the outer surface of the plate body portion.

7. The nozzle plate for a fuel injection device according to claim 1, wherein:

each of the nozzle holes includes the fuel inflow-side opening end positioned on the bottom surface of the swirl chamber, and the fuel outflow-side opening end positioned on the outer surface of the plate body portion;

the portion near the fuel-inflow end of each of the nozzle holes is configured to have the same flow passage cross-sectional area from the fuel inflow-side opening end to the fuel outflow-side opening end; and in the portion near the fuel-outflow end of each of the nozzle holes, an inner surface of each of the nozzle holes at upstream end side of the fuel flow direction is the curved surface, and an inner surface of each of the nozzle holes at downstream end side of the fuel flow direction is a tapered surface smoothly connected to the curved surface.

* * * * *